US008925984B2

(12) United States Patent
Joseph-de Saram et al.

(10) Patent No.: US 8,925,984 B2
(45) Date of Patent: Jan. 6, 2015

(54) WASTE PICK-UP AND STORAGE DEVICE

(71) Applicants: Praveena Joseph-de Saram, Philadelphia, PA (US); Markus Manfred Helmut Mittermaier, Philadelphia, PA (US)

(72) Inventors: Praveena Joseph-de Saram, Philadelphia, PA (US); Markus Manfred Helmut Mittermaier, Philadelphia, PA (US)

(73) Assignee: Poopooh LLC, Princeton Junction, NJ (US)

( * ) Notice: Subject to any disclaimer, the term of this patent is extended or adjusted under 35 U.S.C. 154(b) by 0 days.

(21) Appl. No.: 13/830,544

(22) Filed: Mar. 14, 2013

(65) Prior Publication Data

US 2014/0260110 A1 Sep. 18, 2014

(51) Int. Cl.
*A01K 29/00* (2006.01)
*E01H 1/12* (2006.01)

(52) U.S. Cl.
CPC ..... *E01H 1/1206* (2013.01)
USPC ..... 294/1.3

(58) Field of Classification Search
CPC ..... E01H 1/1206
USPC ..... 294/1.3, 214; 15/104.8, 257.1; 383/4, 383/12
See application file for complete search history.

(56) References Cited

U.S. PATENT DOCUMENTS 3,676,887 A 7/1972 Klein
3,685,088 A * 8/1972 Doherty ..... 294/1.3
3,739,418 A 6/1973 Yonaites
3,827,098 A * 8/1974 Sanderson ..... 294/1.4
3,830,423 A * 8/1974 Prescott ..... 294/1.3
3,978,540 A 9/1976 Peck
3,986,744 A * 10/1976 Krogstad et al. ..... 294/1.3
4,138,153 A 2/1979 Brown
4,205,869 A * 6/1980 Mathis ..... 294/1.3
4,252,356 A 2/1981 Tokuzumi
4,747,633 A * 5/1988 Stacy ..... 294/1.3
4,948,266 A * 8/1990 Bencic ..... 383/34
5,186,384 A * 2/1993 Nelson ..... 229/122
5,222,777 A * 6/1993 Clonch ..... 294/1.3
5,282,660 A 2/1994 Halling
5,584,519 A 12/1996 Myles
5,702,138 A * 12/1997 Elkind ..... 294/1.4

(Continued)

FOREIGN PATENT DOCUMENTS

EP 2 520 720 A3 4/2013
NL 1 028 175 C1 8/2006

OTHER PUBLICATIONS https://dispoz-a-scoop.com/scoops-for-dogs, Dispoz-a-scoop for Dogs, (copyright 2009, retrieved 2014).

*Primary Examiner* — Dean Kramer
(74) *Attorney, Agent, or Firm* — Kenyon & Kenyon LLP

(57) ABSTRACT

The present invention is a waste pick-up and storage device for scooping solid and semi-solid pet waste. The device includes a bag portion and a scoop portion. In an embodiment, two scoops scoop the pet waste into the bag. In an embodiment, a portion of the scoop is detachable, and another portion is secured to the bag for providing support. The scoop is used to sweep the pet waste into the bag. The scoop portions can serve as handles of the device. In an embodiment, the device can be single-handed. The device can have a receptacle, a cover rotatably attached to the receptacle, and wherein the cover has a handle attached to a surface opposite the base of the receptacle. The waste pick-up and storage device is foldable to be flat, and can be made from a combination of flexible materials for the bag, and inflexible materials for the scoop.

19 Claims, 41 Drawing Sheets

(56) References Cited

U.S. PATENT DOCUMENTS

| | | | |
|---|---|---|---|
| 6,045,170 | A | 4/2000 | Allen |
| 6,832,796 | B1 | 12/2004 | Minassians |
| 7,625,026 | B2 | 12/2009 | Lau |
| 7,976,083 | B2 | 7/2011 | Black |
| 2006/0279097 | A1 | 12/2006 | Jones |
| 2008/0048463 | A1 | 2/2008 | Selenke |
| 2009/0278365 | A1 | 11/2009 | Hawks |
| 2010/0045056 | A1 | 2/2010 | Greenhut |

* cited by examiner

250

330

410

450

630

700

760

765

770

785

800

865

870

875

880

900

910

WASTE PICK-UP AND STORAGE DEVICE

CROSS-REFERENCE TO RELATED APPLICATION

This application claims priority to U.S. Nonprovisional application Ser. No. 13/829,610, filed on Mar. 14, 2013, entitled "Waste Pick-up and Storage Device," and U.S. Nonprovisional application Ser. No. 13/830,426, filed on Mar. 14, 2013, entitled "Waste Pick-up and Storage Device," each of which is herein incorporated by reference in its entirety.

FIELD OF THE INVENTION

The present invention relates to a device for picking up and storing solid and semi-solid objects, and more specifically relates to the pick-up and storage of pet waste.

BACKGROUND INFORMATION

Containers and devices for picking up and storing objects can be designed in a plethora of ways to accommodate varying needs. Storage containers isolate its contents from the environment and assist in the storage and transport of objects. Likewise, pick-up devices such as brooms and scoops, developed from a need to avoid touching unsanitary objects or those that are difficult to pick up. An efficient and easy-to-use device for picking up refuse without soiling the user's hands is integral to human and environmental hygiene. Various devices for containing and storing objects exist, as do devices for sweeping or inserting objects into containers. However, there exist few devices that integrate the functions of containment and scooping. Animal waste is particularly challenging to scoop and store for disposal, especially when garbage disposal is not readily at hand.

Pet owners can take pets to public areas for exercise and leisure. Pets are often trained to relieve themselves outdoors in private or public areas. In urban environments, ordinances require pet owners to remove pet waste from public areas. The pet owner must have a way to scoop and store the pet's waste until a proper garbage disposal is found. Depending on the pet's diet and state of health, its byproduct can be semi-solid. Therefore, there exists a need to pick up and store pet waste for eventual disposal. Such a device would improve hygiene and enhance the pleasure of taking one's pet for a walk.

Devices exist for cleaning up after dogs, for example plastic bags can be inverted to pick up the waste by hand by the user and tied up for storage until proper garbage disposal is found. However, existing methods generally require at least indirect contact with the pet waste and may not be able to pick up all of the pet waste when it is not completely solid. Therefore, there exists a need to pick up and store pet waste without requiring even indirect contact with the waste. There also exists a need to pick up pet waste that is not entirely solid.

SUMMARY OF THE INVENTION

The present invention provides for a waste pick-up and storage device that avoids both direct and indirect contact with waste, including semi-solid waste. The device is foldable, closeable, and portable. An embodiment can include a two-handed device and a single-handed device. In an embodiment, a receptacle is provided having two hard surfaces for scooping up waste. In an embodiment, one of the hard surfaces has a portion that is detachable for sweeping the waste into the receptacle. In an embodiment, the receptacle only has a single hard surface, a portion of which is detachable for use as a scoop. The receptacle can be made from a flexible material such as paper or plastic, and the hard surfaces can be made from an at least semi-stiff material such as paperboard. The scoops can have chamfered edges.

In an embodiment, a waste pick-up and storage device includes receptacle having a first surface, a second surface, and an opening. The waste pick-up and storage device further comprises at least one panel wherein a first portion of the panel is attached to the receptacle such that the panel is rotatable around the opening of the receptacle from a first surface to a second surface. In an embodiment, a waste pick-up and storage device include a flexible receptacle having an opening, an inner surface, and an outer surface. The waste pick-up and storage device comprises a first panel positioned on the outer surface of the receptacle such that a first portion of the first panel extends beyond the opening of the receptacle and a second portion of the first panel overlaps with at least part of the receptacle. The waste pick-up and storage device a second panel positioned approximately opposite the first panel on the outer surface of the receptacle such that a first portion of the second panel extends beyond the opening of the receptacle and a second portion of the second panel overlaps with at least part of the receptacle, wherein the first panel and second panel are attached to the outer surface of the receptacle by respective strips substantially parallel to the opening, the strip forming an axis of rotation about which the first panel and the second panel is rotatable.

In an embodiment, the first portions of the first panel and the second panel each has a cut-out portion and the first panel. The strips by which the first panel and the second panel are respectively attached to the outer surface of the receptacle is located below the cut-out portions. In an embodiment, the first panel and the second panel each has a grip and the first panel and the second panel are each attached to the outer surface of the receptacle below the grip.

In an embodiment, the receptacle is made of plastic. In an embodiment, the receptacle is made of paper. In an embodiment, the waste pick-up and storage device has a portion of the inner surface has an adhesive capable of at least partially sealing the receptacle opening.

In an embodiment, a waste pick-up and storage device has a flexible receptacle having an opening, an inner surface, and an outer surface. The waste pick-up and storage device has a first panel positioned on the inner surface of the receptacle, the first panel being attached to the receptacle by a first strip such that the first panel is rotatable about the first strip. The waste pick-up and storage device has a second panel positioned on the inner surface of the receptacle, the second panel being attached to the receptacle by a second strip such that the second panel is rotatable about the second strip.

In an embodiment, the flexible receptacle of the waste pick-up and storage device further has at least one handle.

In an embodiment, a waste pick-up and storage device has a receptacle capable of being folded flat, having an opening, a bottom, a first side, a second side, a third side, and a fourth side, each side having an inner surface and an outer surface. The waste pick-up and storage device has the first side and the second side are situation opposite each other and are each taller than the third side and the fourth side. The waste pick-up and storage device has a first panel positioned on at least part of the inner surface of the first side such that a portion of the first panel extends beyond the end of the third side and the fourth side and the portion of the first panel extending beyond the end of the third side and the fourth side is not attached to the inner surface of the first side. The waste pick-up and storage device has a second panel positioned on at least part of the inner surface of the second side such that a portion of the second panel extends beyond the end of the third side and the fourth side and the portion of the second panel extending beyond the end of the third side and the fourth side is not attached to the inner surface of the second side. The waste pick-up and storage device has the third side and the fourth side each has a first crease, a second crease, and a third crease such that when folded form a "v" shape, the bottom of the "v" being closer to the bottom of the receptacle. The waste pick-up and storage device has the edges of the first and second panel have chamfer cuts such that the cuts fit in the "v" shape formed by the first, second, and third creases.

In an embodiment, the first side and the second side of the waste pick-up and storage device each has a cut-out portion and the first panel and the second panel are each attached to the inner surface of respective first and second sides below the cut-out portions. In an embodiment, the flexible receptacle further has a drawstring, such that the drawstring seals the opening of the receptacle. The flexible receptacle can have a drawstring, such that the drawstring seals the opening of the receptacle.

In an embodiment, there is a method for picking up and storing an object without coming into contact with the object using a device having a receptacle and two panels rotatably attached to the receptacle. A user can pick-up and store an object, for example, pet waste, by positioning the receptacle over the object with at least one panel. A receptacle having two panels at least partially attached can be located approximately on either side of the object. The method includes rotating the panels into a position to insert the object into the receptacle. The method includes the user moving, or bringing the two panels towards each other and rotating the panels towards opening of the receptacle such that the two panels lift the object onto the panels and angled towards the inside of the receptacle. The panels can rotate about an axis substantially parallel to the opening of the receptacle. The axis of rotation can be located where the panels are attached to the receptacle. The method also includes inverting the receptacle to hold the object.

In an embodiment, the method includes at least one of: closing and sealing the receptacle. A drawstring can be movably attached to the receptacle for closing and sealing the receptacle.

In an embodiment, a waste pick-up and storage device has a receptacle and at least one panel having a first portion of the panel attached to the receptacle and a second portion of the panel is detachably attached to the first portion.

In an embodiment, a waste pick-up and storage device has a flexible receptacle having an opening, an inner surface, and an outer surface. The waste pick-up and storage device has a panel having a first portion and a second portion, the first portion and the second portion being detachably connected to each other. The first portion of the panel of the waste pick-up and storage device is attached to the inner surface of the receptacle such that it provides a support for the flexible receptacle.

In an embodiment, the second portion of the panel is not attached to the receptacle. In an embodiment, the second portion of the panel is attached to the surface of the receptacle. The second portion of the panel can be attached to any surface of the receptacle. The second portion of the panel is removably attached to the receptacle by an adhesive. The adhesive can remain on the receptacle, such that the adhesive can be used to seal the receptacle. The adhesive can include epoxy, glue, tape, and/or coating. A coating can be a sticky coating. The adhesive can adhere the second portion of the panel to the receptacle, such that the second portion of the panel remains attached to the receptacle until the user uses the device.

In an embodiment, a waste pick-up and storage device has a receptacle having an opening, a first side, a second side opposite the first side and joined to the first side by a seam, a third side that is shorter than the first side and the second side, the third side having creasing such that the receptacle is foldable, and a fourth side that is shorter than the first side and the second side, the fourth side having creasing such that the receptacle is foldable. The waste pick-up and storage device has a panel having a first portion and a second portion, the first portion and the second portion being detachably connected to each other, the first portion of the panel being attached to the inner surface of the first side such that it provides support for the flexible receptacle. In an embodiment, the second portion of the panel is not attached to the first portion. The second portion can be detached and positioned inside the receptacle prior to use. The second portion can be removably attached to the receptacle.

In an embodiment, the second portion of the panel is not attached to the receptacle. In an embodiment, the second portion of the panel is attached to the surface of the receptacle. The second portion of the panel can be attached to any surface of the receptacle. The second portion of the panel is removably attached to the receptacle by an adhesive. The adhesive can remain on the receptacle, such that the adhesive can be used to seal the receptacle. The adhesive can include epoxy, glue, tape, and/or coating. A coating can be a sticky coating. The adhesive can adhere the second portion of the panel to the receptacle, such that the second portion of the panel remains attached to the receptacle until the user uses the device. In an embodiment, the device is capable of being folded flat.

In an embodiment, a waste pick-up and storage device has a flexible receptacle having a four-sided opening, a first wing extending from a first side of the opening, a second wing extending from a second side of the opening. The waste pick-up and storage device has a panel having a first portion and a second portion, the first portion and the second portion being detachably connected to each other. The first portion of the panel of the waste pick-up and storage device is attached to the inner surface of the first side such that it provides support for the flexible receptacle In an embodiment, the second portion of the panel is not attached to the inner surface of the receptacle. The second portion of the panel can coincide at least in part with the first wing.

In an embodiment, the second portion of the panel is not attached to the receptacle. In an embodiment, the second portion of the panel is attached to the surface of the receptacle. The second portion of the panel can be attached to any surface of the receptacle. The second portion of the panel is removably attached to the receptacle by an adhesive. The adhesive can remain on the receptacle, such that the adhesive can be used to seal the receptacle. The adhesive can include epoxy, glue, tape, and/or coating. A coating can be a sticky coating. The adhesive can adhere the second portion of the panel to the receptacle, such that the second portion of the panel remains attached to the receptacle until the user uses the device. In an embodiment, the device is capable of being folded flat.

In an embodiment, a method for picking up and storing an object without coming into contact with the object using a device having a receptacle and at least one panel having a portion detachably connected to the receptacle includes detaching the portion of the panel. The method includes placing the portion at least one of: underneath and to the side, of the object. The method includes moving the object into the receptacle using the force of the detached portion of the panel such that the entirety of the object is into the receptacle. The portion of the panel remaining inside the receptacle provides structure to the receptacle. The portion remaining in the receptacle can be fixedly attached to the receptacle.

In an embodiment, the detachable portion is pre-detached. In an embodiment, the portion is removably attached to any surface of the receptacle. The portion can be removed from any surface. In an embodiment, an adhesive can be used to removably attach a portion to the bag. The remaining adhesive on the surface of the receptacle can be used to seal the bag after waste pick-up.

In an embodiment, the method includes least one of: closing and sealing the receptacle. A drawstring can be movably attached to the receptacle for closing and sealing the receptacle. The receptacle can include a drawstring, such that the drawstring seals the opening of the receptacle.

In an embodiment, a waste pick-up and storage device includes a receptacle, the receptacle having a base and four sides, wherein a first and second side are opposite from each other, and a third side is opposite from a fourth side. waste pick-up and storage device includes a cover rotatably attached to the receptacle. In an embodiment, the first, second, third, and fourth sides of the waste pick-up and storage device are flexible. In an embodiment, a portion of the fourth side of the waste pick-up and storage device encloses the cover. In an embodiment, a portion of the third side of the waste pick-up and storage device is rotatable around an axis substantially parallel to the third side and substantially perpendicular to the first and second sides. In an embodiment, a portion of the fourth side of the waste pick-up and storage device is rotatable around an axis substantially parallel to the fourth side and substantially perpendicular to the first and second sides.

In an embodiment, the cover of the waste pick-up and storage device has a handle attached to a surface opposite the base of the receptacle. In an embodiment, the cover of the waste pick-up and storage device is inflexible.

In an embodiment, the first and second sides of the waste pick-up and storage device are a first height, the third side is a second height, and the fourth side is a third height. The second height can be larger than the first height. The third height can be larger than the first height. The third height can be larger than the second height, and the second height is larger than the first height.

In an embodiment, the cover of the waste pick-up and storage device is rotatable around an axis substantially parallel to the third side and substantially perpendicular to the first and second sides.

In an embodiment, the third and fourth sides of the waste pick-up and storage device have cutouts. The cutout can be shaped to fit a user's hand. The cutout can be any shape, including, oval, square, rectangular, and circular. In an embodiment, the cutouts on the third and fourth sides are positioned to match each other. The cutouts can be distanced the same amount from the upper edge of the sides, so the user can hold the receptacle using the cutouts.

In an embodiment, the handle of the waste pick-up and storage device is enclosed on one end. In an embodiment, the handle can be a strap. The user can position their hand underneath the strap, and/or wrap the strap around the user's wrist to secure the device to the user's hand.

In an embodiment, the first and second sides of the waste pick-up and storage device each have a reinforcement strip positioned substantially parallel to the first and second sides and substantially perpendicular to the third and fourth sides and attached at the first height. The reinforcement strip of the waste pick-up and storage device is inflexible.

In an embodiment, the waste pick-up and storage device has a panel attached to at least a portion of the third side. The panel of the waste pick-up and storage device is inflexible.

In an embodiment, a waste pick-up and storage device includes a receptacle having an opening, a frame, wherein the frame is attached to the opening of the receptacle, and a cover rotatably attached to the frame and/or receptacle. The cover of the waste pick-up and storage device has a handle attached to a surface opposite the base of the receptacle. In an embodiment, the cover of the waste pick-up and storage device is inflexible. In an embodiment, the frame of the waste pick-up and storage device can be a wire frame. The frame is shaped to match the shape of the cover.

In an embodiment, the waste pick-up and storage device includes a first flap attached to a first side of the frame and/or receptacle and positioned opposite from a second flap attached to a second side of the frame and/or receptacle. In an embodiment, the first flap of the waste pick-up and storage device is rotatable around an axis substantially parallel to the first side of the frame. In an embodiment, the second flap of the waste pick-up and storage device is rotatable around an axis substantially parallel to the second side of the frame.

In an embodiment, the first flap of the waste pick-up and storage device has a first height and the second flap has a second height. In an embodiment, the first height can be larger than the second height. In an embodiment, the first and second flaps are flexible.

In an embodiment, the handle of the waste pick-up and storage device is enclosed on one end. In an embodiment, the handle can be a strap. The user can position their hand underneath the strap, and/or wrap the strap around the user's wrist to secure the device to the user's hand.

In an embodiment, the first and second flaps of the waste pick-up and storage device have cutouts. The cutout can be shaped to fit a user's hand. The cutout can be any shape, including, oval, square, rectangular, and circular. In an embodiment, the cutouts on the first and second flaps are positioned to match each other. The cutouts can be distanced the same amount from the upper edge of the sides, so the user can hold the receptacle using the cutouts. In an embodiment, a portion of the first flap of the waste pick-up and storage device encloses the cover.

In an embodiment of the waste pick-up and storage device, the receptacle further includes a drawstring, such that the drawstring seals the opening of the receptacle.

In an embodiment, a waste pick-up and storage device includes a receptacle having a bag having an opening and a frame, wherein the frame is attached to the inside surface of the bag. The device includes a cover rotatably attached to the frame and/or bag. The cover has a handle attached to a surface opposite the base of the bag.

In an embodiment, the frame of the waste pick-up and storage device is positioned in the receptacle such that the bag has a first portion above the frame. In an embodiment, the first portion of the waste pick-up and storage device encloses the cover. In an embodiment, the first portion of the waste pick-up and storage device includes a drawstring.

In an embodiment, a method for picking up and storing an object using a singled-handed device includes rotating a cover to open a receptacle, the receptacle having a base and four sides and a user inverting the receptacle such that the opening is towards an object, wherein the user manipulates the device by a handle attached to the cover. The method includes using the cover to move an object into the receptacle, and inverting the receptacle for storage. The method can also include closing and/or sealing the receptacle. The cover can move the object into the receptacle when the user manipulates a hand to close the cover over the opening. The cover can push, slide, and/or force the object into the opening of the receptacle for storage. In an embodiment, the method includes closing and/or sealing the receptacle for storage.

DETAILED DESCRIPTION

Figure 1A:
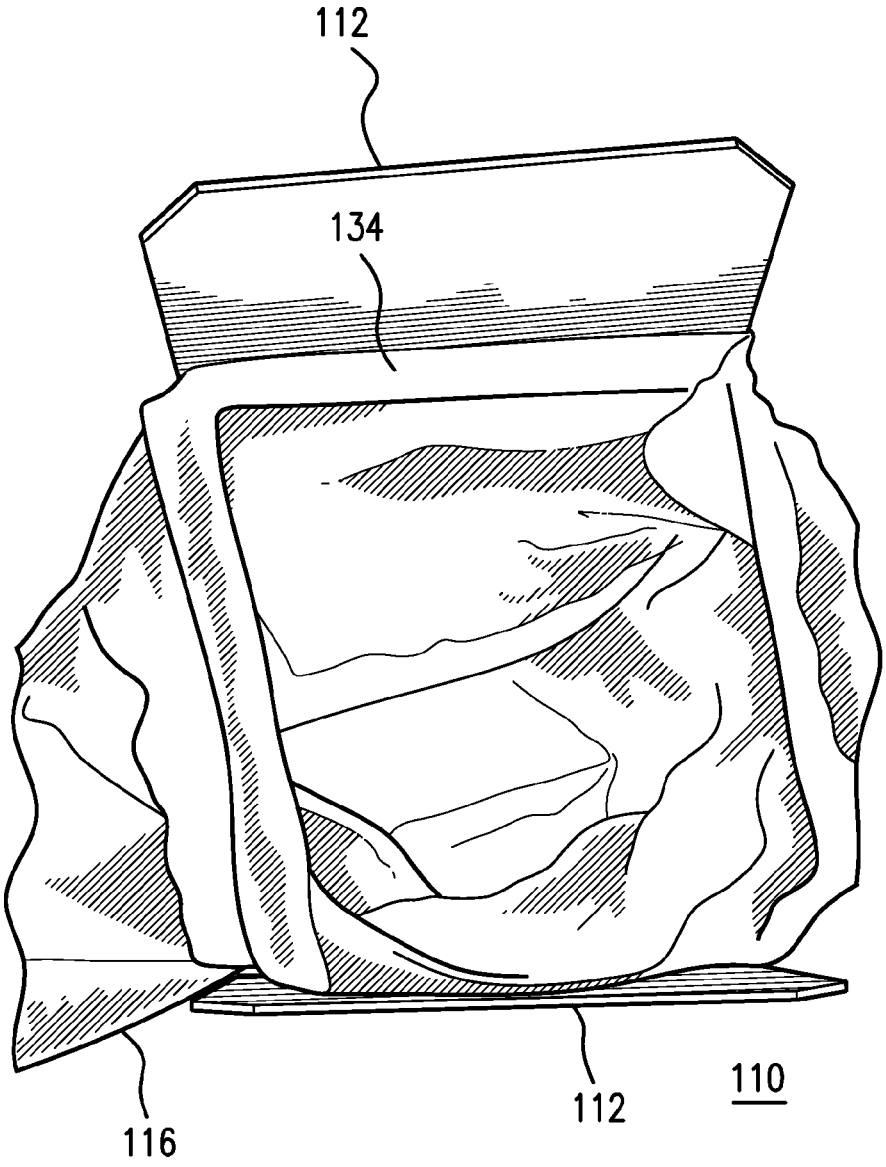
FIG. 1A is a top-down view of an example of a double-scoop waste pick-up and storage device according to an embodiment of the present invention.
Figure 1B:
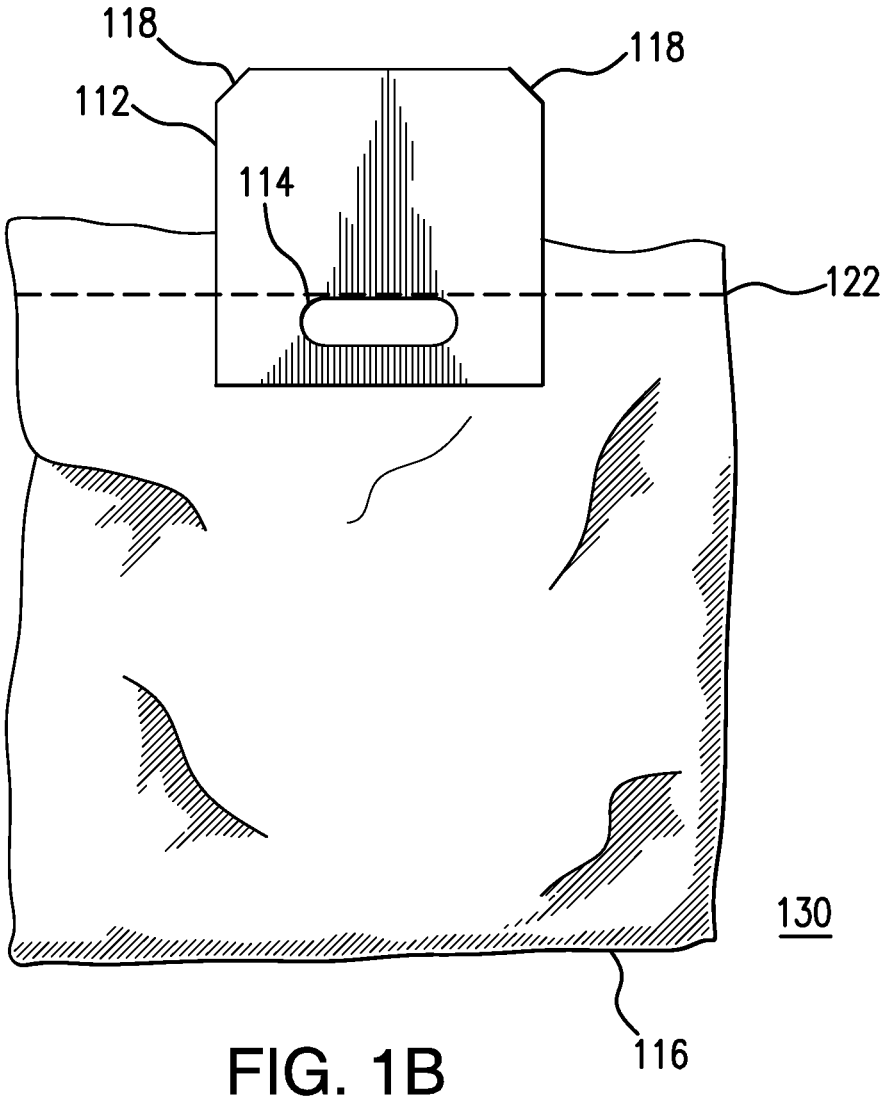
FIG. 1B is a side view of an example of a double-scoop waste pick-up and storage device according to an embodiment of the present invention.
Figure 1C:
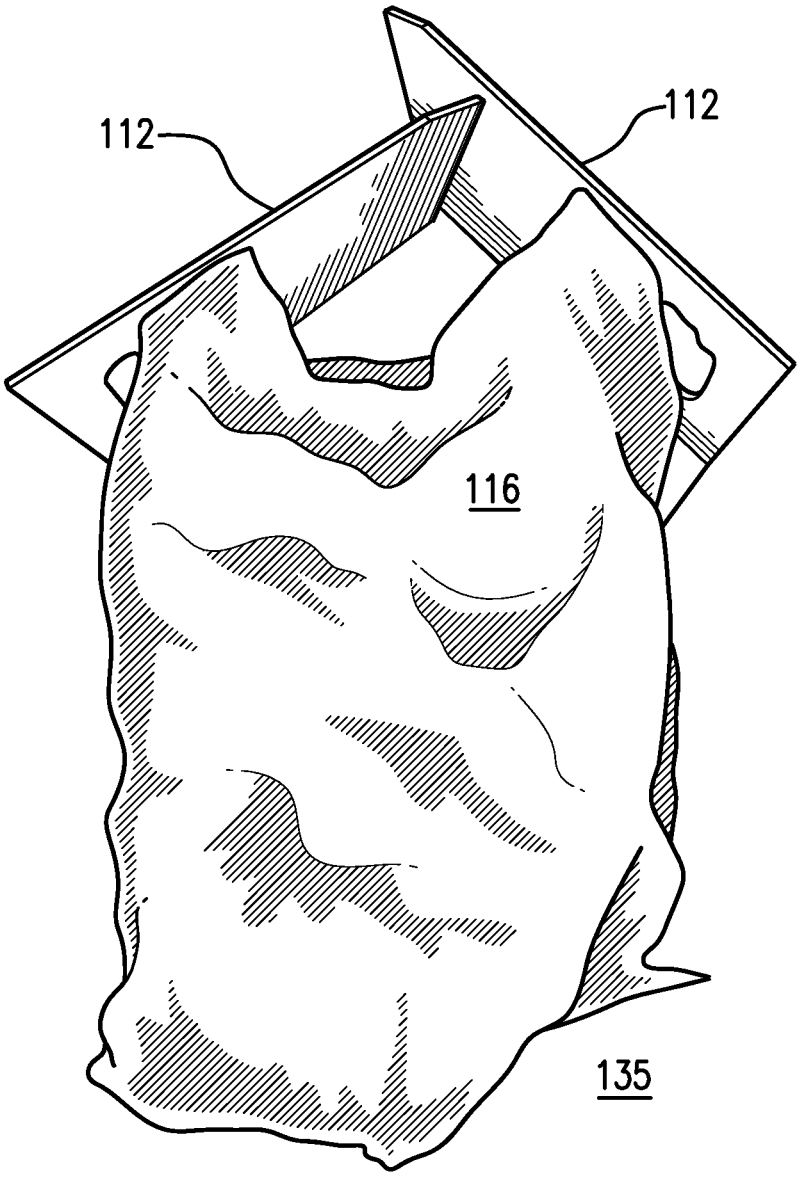
FIG. 1C is a side view of an example of a double-scoop waste pick-up and storage device according to an embodiment of the present invention.
Figure 1D:
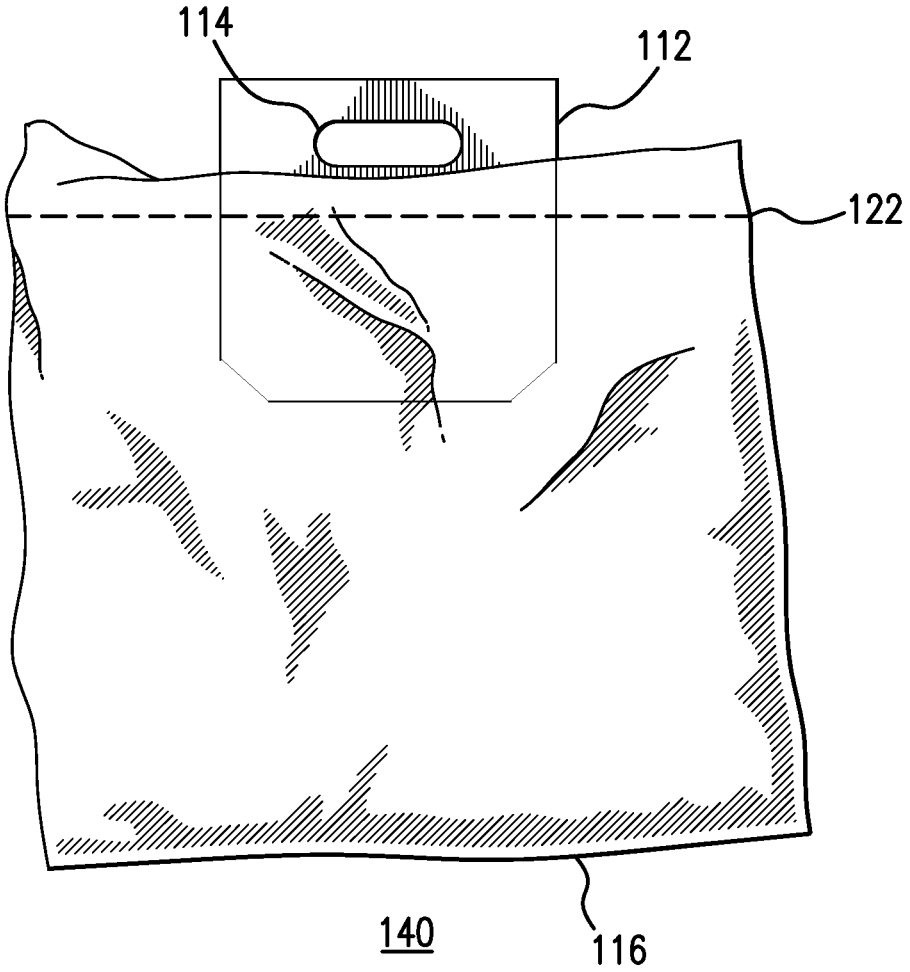
FIG. 1D is another side view of an example of a double-scoop waste pick-up and storage device according to an embodiment of the present invention.

FIGS. 1A to 1F show an example of a waste pick-up and storage device according to an embodiment of the present invention. FIG. 1A is a top-down view 110 of a double-scoop waste pick-up and storage device. FIG. 1B is a side view 130 of an example of a double-scoop waste pick-up and storage device according to an embodiment of the present invention. The waste pick-up and storage device has a receptacle 116 (also referred to as "container" and/or "bag") and at least one flap 112 (also referred to as "panels"). The flaps 112 can be positioned diametrically opposite of each other on the receptacle 116. The flaps 112 can protrude from an opening of the receptacle 116. The flaps 112 can have cut-outs 114 (also referred to as "grips") to improve grip and/or serve as handles. Grips, or handles, can be any shape, including but not limited to rectangular, square, and oval. The edges of the flaps can be chamfered 118 (also referred to as "scallops"), be rounded (not shown), and/or be rectangular in shape (not shown). Scallops can be cuts along the edge of the flap creating teeth for gripping. Scallops can also include at least one rounded cut along the edge of the flap 112. Each of the flaps 112 is attached to the outside surface of the receptacle 116 by a strip 134, such that the strip 134 forms an axis of rotation 122 and the remainder of each of the flaps 112 remains free to rotate about the axis 122. For example, the flaps 112 are rotatable, such that they can rotate approximately 180 degrees around the axis of rotation 122 from the outside surface of the receptacle 116 to the inside surface of the receptacle 116. Each flap 112 has an axis of rotation 122 at the strip 134. FIG. 1C is a side view 135 showing the flaps 112 partially rotated from the outside of the receptacle 116 to the inside of the receptacle 116. FIG. 1D shows a side view 140 of the receptacle 116 with the flaps 112 rotated to the inside surface of the receptacle 116. The grips 114 still protrude from the opening of the receptacle 116.

The term "scoop" is used to describe a tool to propel an object into the device. A scoop can have a flat surface. A scoop can be any shape and thickness. A scoop is preferably thick enough to withstand plastic deformation and/or breakage from use, but not to add significant bulk to the device. For example, a scoop can be about the thickness of cardboard, heavy paper, and/or a hard plastic shell. A scoop can be a panel, flap, and/or cover.

The flaps 112 can be made from an inflexible material, such as cardboard or plastic. The flaps 112 can be planar such that the waste pick-up and storage device can be stored flat. In an embodiment, the flaps 112 are positioned substantially opposite from each other, at or near the opening of the receptacle 116. In an embodiment, the top edge of the flaps 112 can be curved for easier scooping. In an embodiment, the entire flaps 112 can be curved for easier scooping. When the flaps 112 are curved at the edges and/or the entire flaps, the device is bulkier to the user because it does not lay flat.

The receptacle 116 can be made from a flexible material, such as a bag. For example, the receptacle 116 can be made from a conventional plastic bag and/or a paper bag.

Figure 1E:
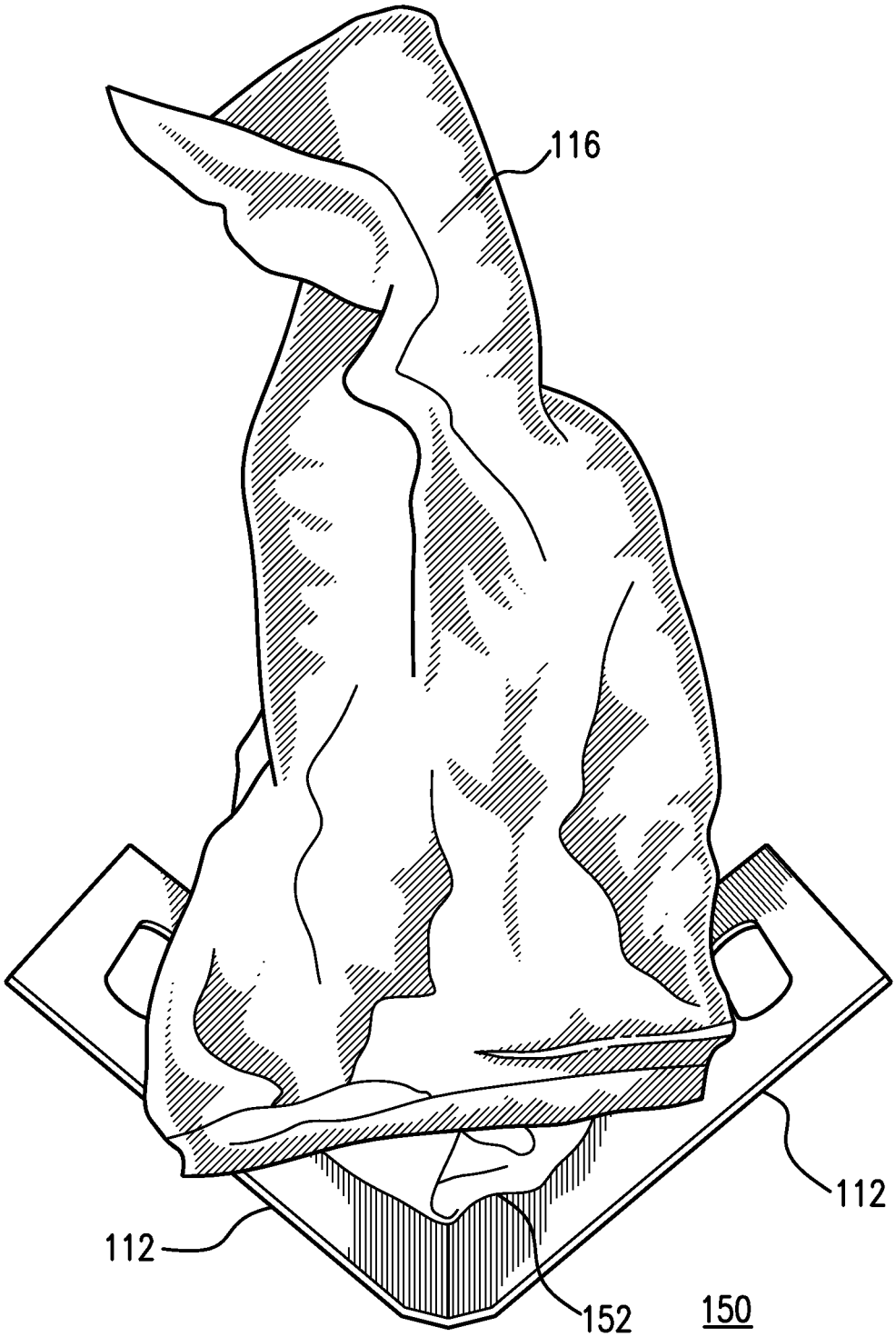
FIG. 1E is a side view of an example of a double-scoop waste pick-up and storage device in a "waste pick-up" mode of operation according to an embodiment of the present invention.

The operation of the waste device can be characterized by three states: "empty," "waste pick-up," and "storage." FIGS. 1A and 1B show the waste device in an empty state. FIG. 1E is a side view 150 of an example of a double-scoop waste pick-up and storage device in a "waste pick-up" mode of operation according to an embodiment of the present invention. To pick up an object 152 resting on a surface, the receptacle 116 is opened by separating the flaps 112. The object 152 can be, for example, litter or waste. The flaps 112 are then rotated around the axis of rotation 112 such that they are on the outside of the receptacle 116 to surround the object 152 (for example, cupping the object 152) such that the bag is substantially above the object 152. Placement of the flaps 112 around the object can be aided by the grips 114. The grips 114 can be handles. For example, a user's finger(s) can curl around the cutout to further separate the hand from the waste and to provide stability. The cutouts can be any shape, including but not limited to rectangular, square, and oval. The edges of the flaps 112 that are in contact with the object 152 and/or the surface upon which the object 152 is resting are then brought towards each other such that they are substantially contacting each other and supporting the object 152. The flaps 112 then rotate around the axis of rotation 122 towards the inside surface of the receptacle 116, such that the object 152 is pushed into the receptacle 116. The waste device can then be inverted or rotated into an upright position.

Figure 1F:
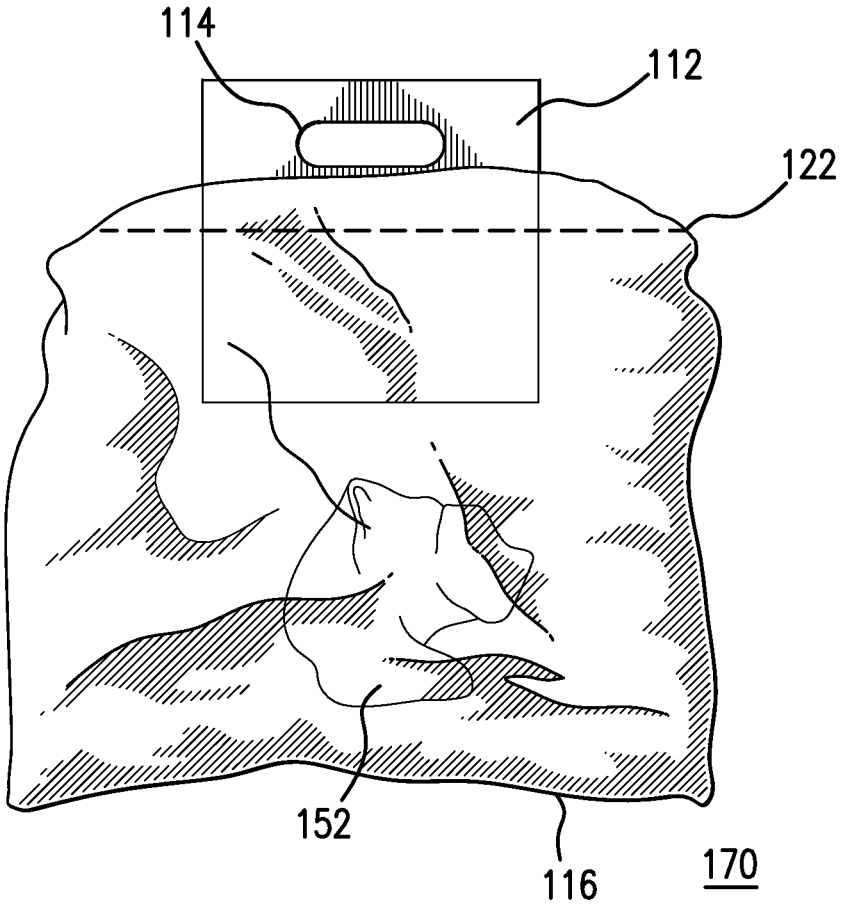
FIG. 1F is a side view of an example of a double-scoop waste pick-up and storage device in a "storing" mode of operation according to an embodiment of the present invention.
Figure 9A:
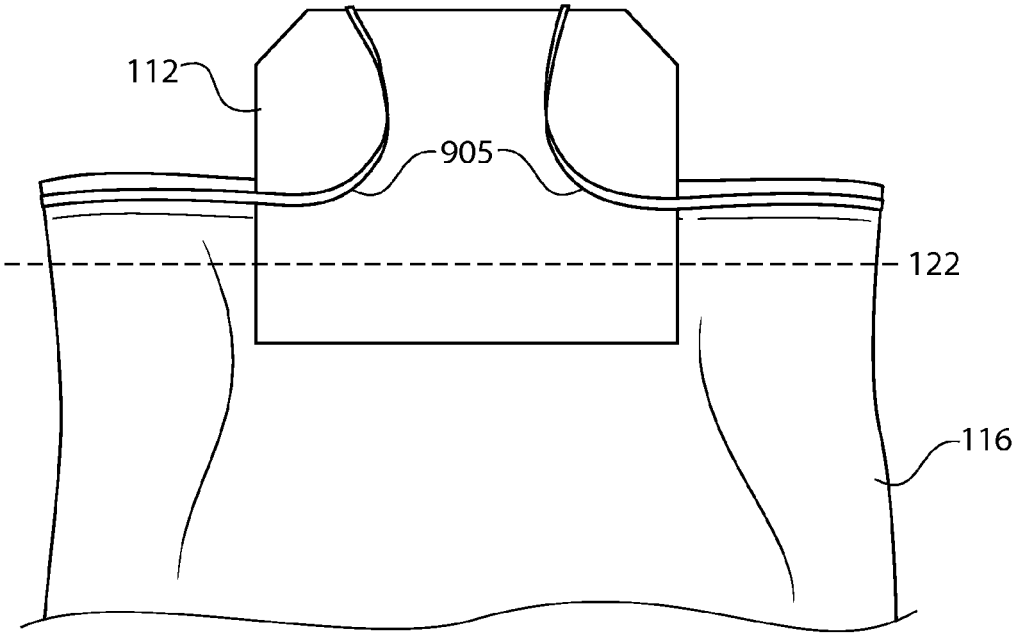
FIG. 9A is a side view of an example of a double-scoop waste pick-up and storage device according to an embodiment of the present invention including a drawstring.
Figure 9B:
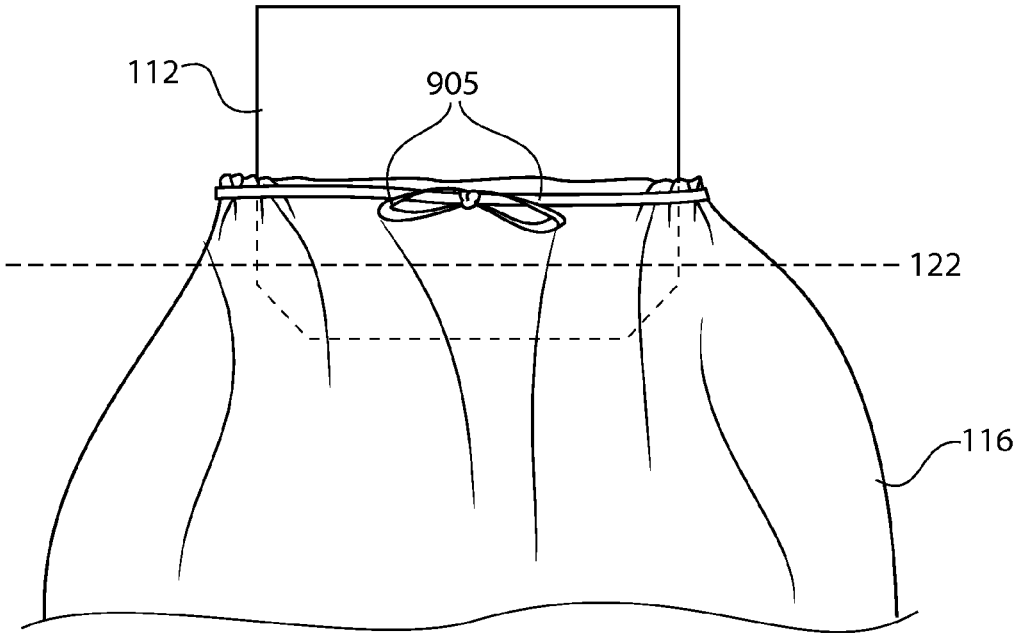
FIG. 9B is a side view of an example of a double-scoop waste pick-up and storage device according to an embodiment of the present invention including a drawstring.

The object 152 can then be safely stored in the receptacle 116. The waste device is then in a "storing" mode of operation. For example, FIG. 1F is a side view 170 of an example of a double-scoop waste pick-up and storage device in a "storing" mode of operation according to an embodiment of the present invention. The flaps 112 can be used for carrying the waste device in a "storing" mode of operation. The receptacle 116 can be sealed, for example, by an adhesive on the surface of the receptacle or a mechanism positioned at or near the opening. The receptacle 116 can be sealed using mechanical joinings, including but not limited to staples and hooks. The receptacle 116 can be sealed using a drawstring. In an embodiment, the receptacle 216 includes a drawstring having two ends drawn substantially opposite of each other at the opening of the receptacle for sealing. In an embodiment, the drawstring can be a continuous drawstring such that the user seals the receptacle manually and/or with a mechanical fastener. FIGS. 9A and 9B show an embodiment of a receptacle having a drawstring with two ends. The ends of the drawstring 905 can be tied and/or joined at or near the flaps 112. When the receptacle is in storage mode, as shown in FIG. 9B, the drawstring 905 can be tied and/or joined to seal the receptacle. In an embodiment, the flaps 112 can protrude from the opening. The drawstring 905 can seal around the flaps 112. The receptacle can then be disposed. In an embodiment, the flaps 112 are removably attached to the receptacle 116, and the receptacle 116 can also be closed by conventional methods such as removing the handles and tying the opening of the bag.

Figure 1G:
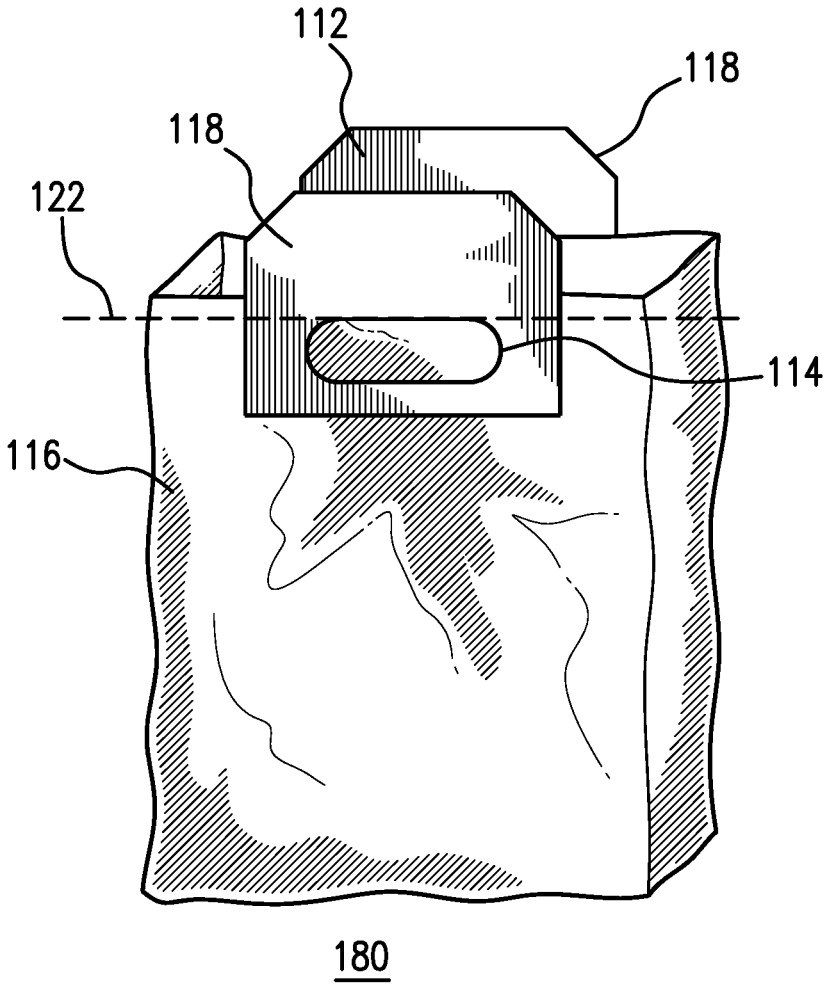
FIG. 1G is a perspective view of an example of a waste pick-up and storage device according to an embodiment of the present invention.

FIG. 1G shows an example of a waste pick-up and storage device according to an embodiment of the present invention. Receptacle 116 can be a container having a base and four sides. The receptacle 116 is flexible to allow rotation of flaps 112 around axis 122. The user can hold the grips 114 to insert the litter or waste into the receptacle.

Figure 2A:
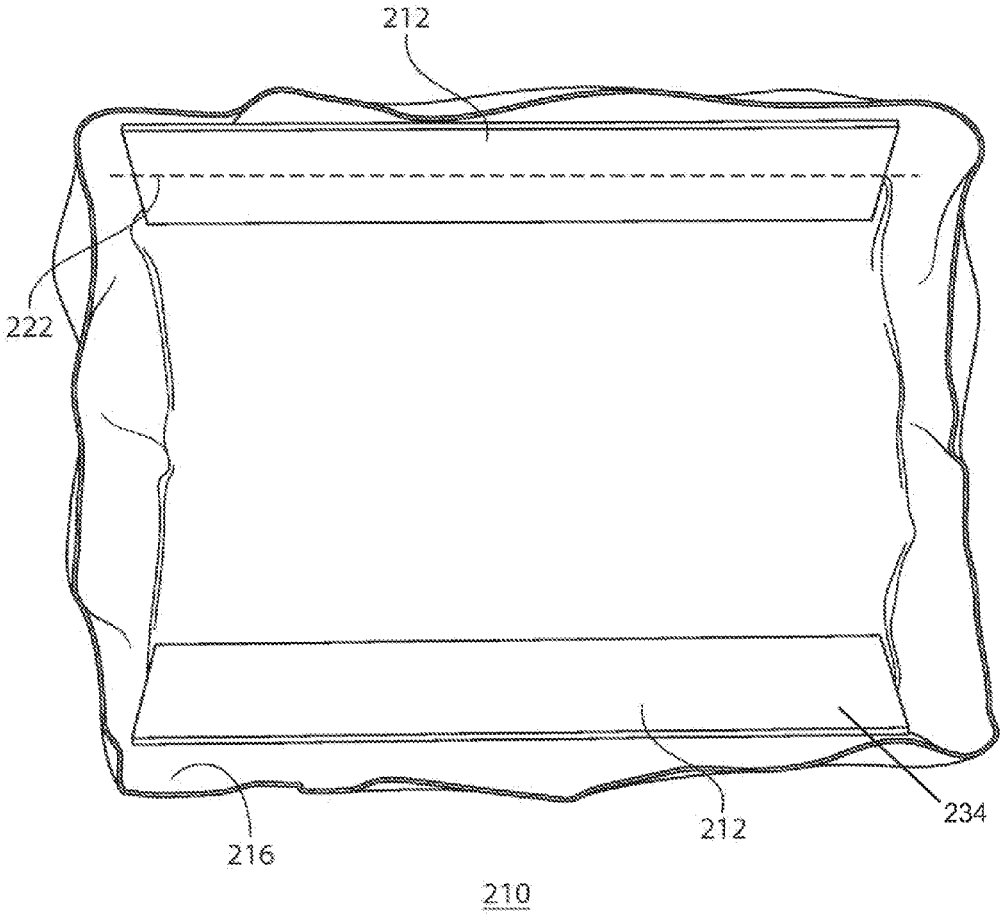
FIG. 2A is a top-down view of an example of a concealable double-scoop waste pick-up and storage device according to an embodiment of the present invention.
Figure 2B:
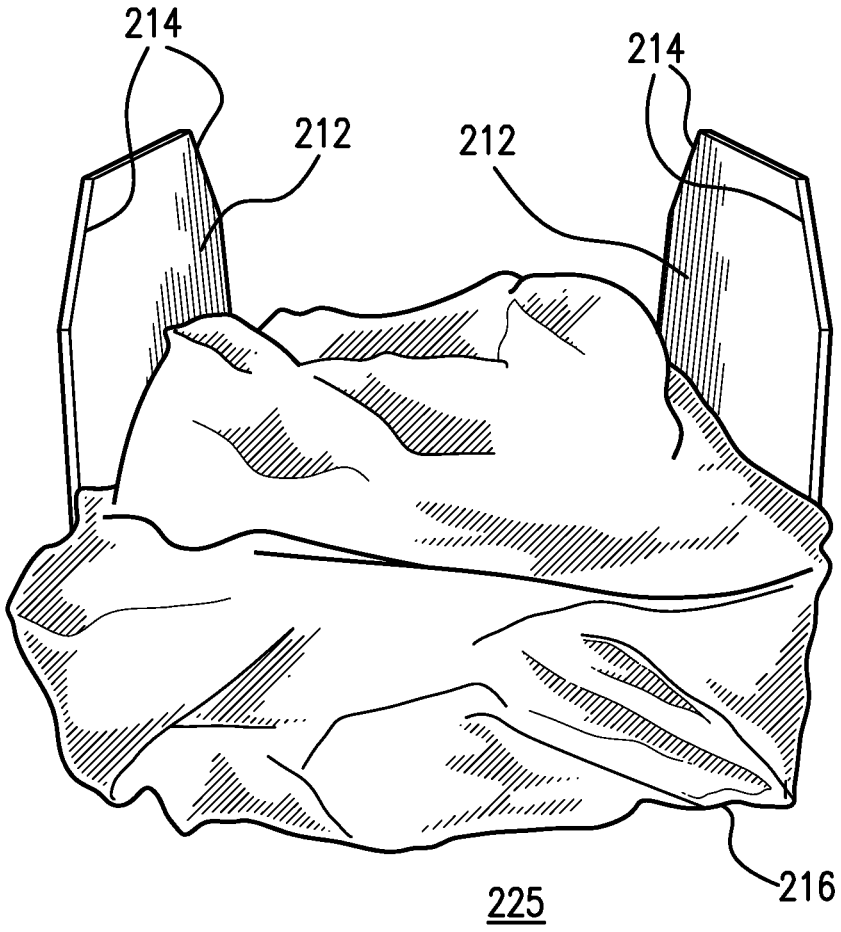
FIG. 2B is a side view of an example of a concealable double-scoop waste pick-up and storage device.

FIGS. 2A to 2D show another example of a waste pick-up and storage device according to an embodiment of the present invention. The waste device of FIGS. 2A to 2C includes a receptacle 216, flaps 212, chamfered edges 214, and axis of rotation 222. FIG. 2A shows a top-down view 210 of an example of a concealable double-scoop waste pick-up and storage device according to an embodiment of the present invention. In an embodiment, the receptacle 216 further includes a means of closure such as handles 218. In an embodiment, the receptacle 216 includes a drawstring having two ends drawn substantially opposite of each other at the opening of the receptacle for sealing. In an embodiment, the drawstring can be a continuous drawstring such that the user seals the receptacle manually and/or with a mechanical fastener. The scoops, or flaps 212, are "concealable" in the sense that the waste device looks like a conventional bag when empty or when storing goods, such as in side view 250, because the flaps 212 are positioned entirely inside the bag in an "empty" or "storing" state. Top-down view 210 shows the device when opened with the flaps 212 rotated about the axis of rotation 222. FIG. 2B is a side view 225 of an example of a concealable double-scoop waste pick-up and storage device. A portion of the flaps 212 are attached to a surface of the receptacle 216 by an adhesive strip 234. The flaps 212 can be positioned such that they are concealed within the receptacle 216. In an embodiment, at least part of the flaps 212 protrude from the opening of the receptacle. At least a portion of the flaps 212 can be attached to the receptacle 216 by any adhesives, including but not limited to glue, epoxy, and tape. At least a portion of the flaps 212 can be attached by a mechanical coupling. A mechanical coupling includes, but is not limited to, staples, hooks, closures, and other known fasteners. The adhesive or coupling can be determined by the materials of the receptacle 216 and/or the flaps 212. In an embodiment, the strip 234 adheres to the plastic receptacle 216. The strip 234 creates an axis of rotation 222 to rotate the flaps 212 so that they protrude from the receptacle 216, as shown in FIG. 2B. In an embodiment, the strip is on the inside surface of the receptacle 222.

Figure 2C:
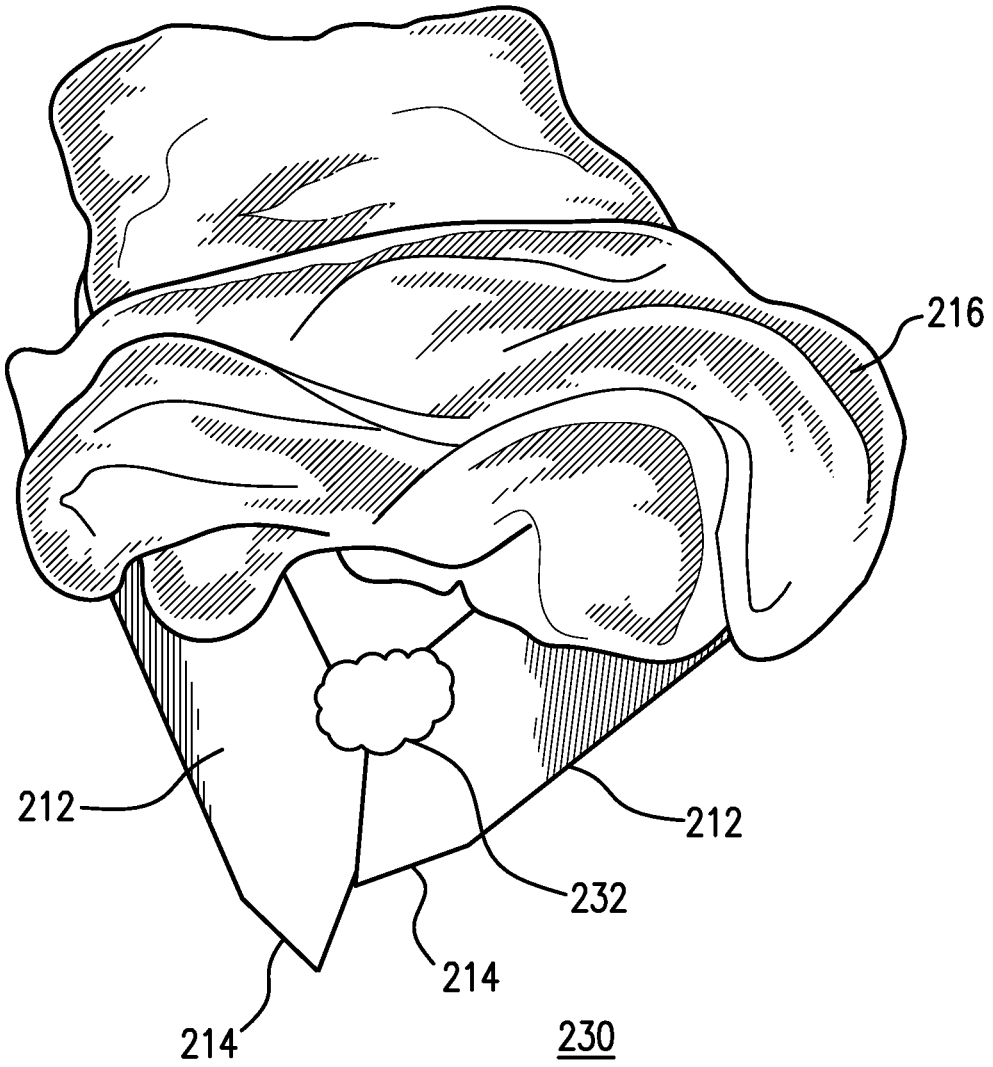
FIG. 2C is a side view of an example of a concealable double-scoop waste pick-up and storage device in a "waste pick-up" mode of operation according to an embodiment of the present invention.
Figure 2D:
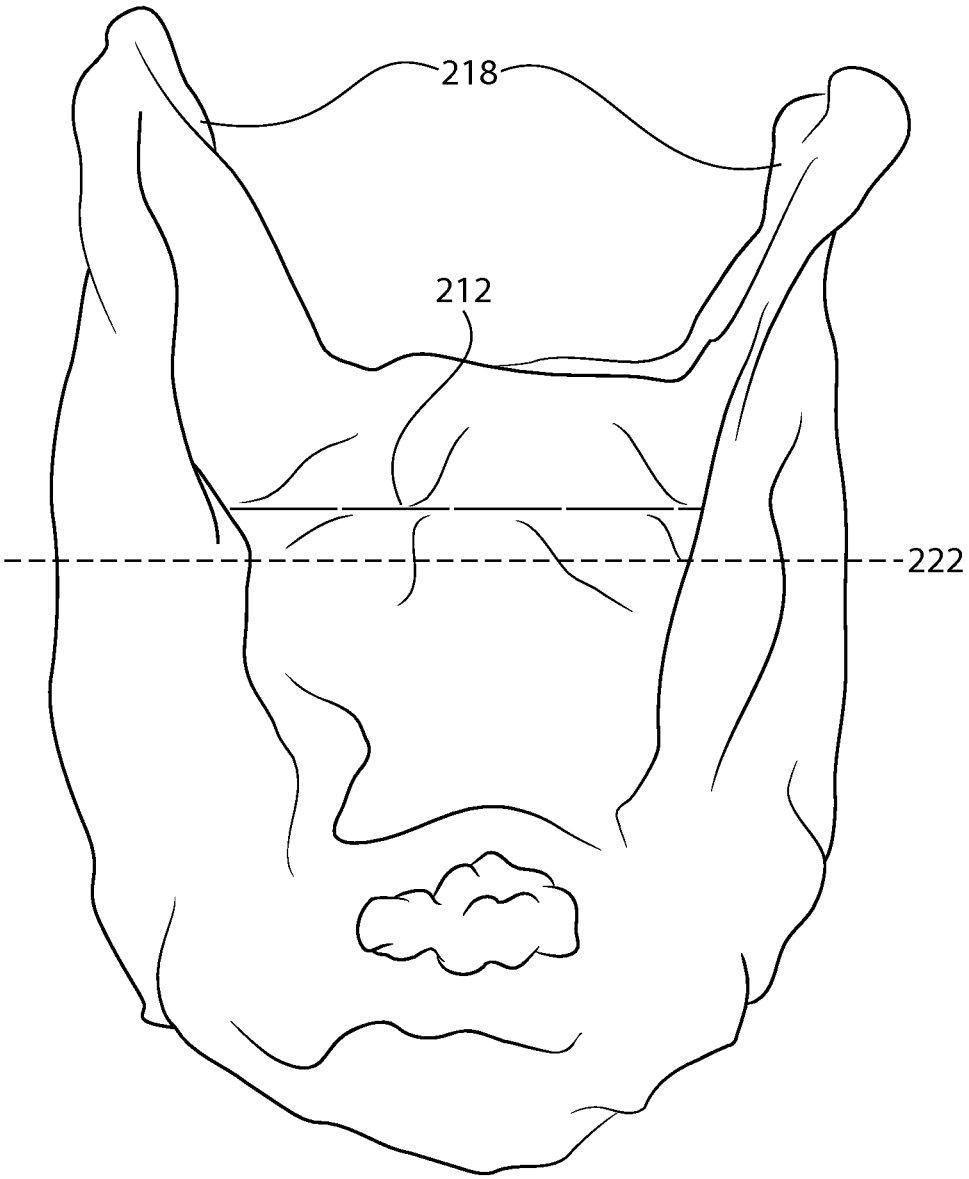
FIG. 2D is a side view of an example of a concealable double-scoop waste pick-up and storage device in a "storing" mode of operation according to an embodiment of the present invention.

FIG. 2C is another side view of an example of a concealable double-scoop waste pick-up and storage device in a "waste pick-up" mode of operation according to an embodiment of the present invention. In the "waste pick-up" mode of operation, the flaps 212 are placed around the object 232 while the flaps 212 are positioned on the inside of the receptacle 216. The flaps 212 can be both rotated toward the opening of the receptacle 216 prior to use, such that the flaps protrude from the opening of the receptacle 216. The user can use the flaps 212 to sweep and/or scoop the litter 232 onto the flaps 212, and rotate the flaps 212 towards the opening of the bag. The flaps 212 can alternatively be both unrotated in the receptacle 216 such that they lie flat to the surface of the bag in waste pick-up mode (not shown). The flaps 212 can also be any combination of rotated and unrotated in waste pick-up mode (not shown). The user can sweep or scoop the litter 232 using the flaps in an unrotated state in the receptacle 216 (not shown). The edges of the flaps 212 that are in contact with the object 232 and/or the surface upon which the object 232 is resting are then brought towards each other such that they are substantially contacting each other and supporting the object 232. The flaps 212 then rotate around the axis of rotation 222 towards the inside surface of the receptacle 216, such that the object 232 is pushed into the receptacle 216. The waste device can then be inverted or rotated into an upright position. The "storage" mode of operation the flaps 212 are positioned, e.g., concealed, inside the receptacle 216 with the object 232, as shown in side view 250. For example, FIG. 2D is a side view 250 of an example of a concealable double-scoop waste pick-up and storage device in a "storing" mode of operation according to an embodiment of the present invention.

Figure 3A:
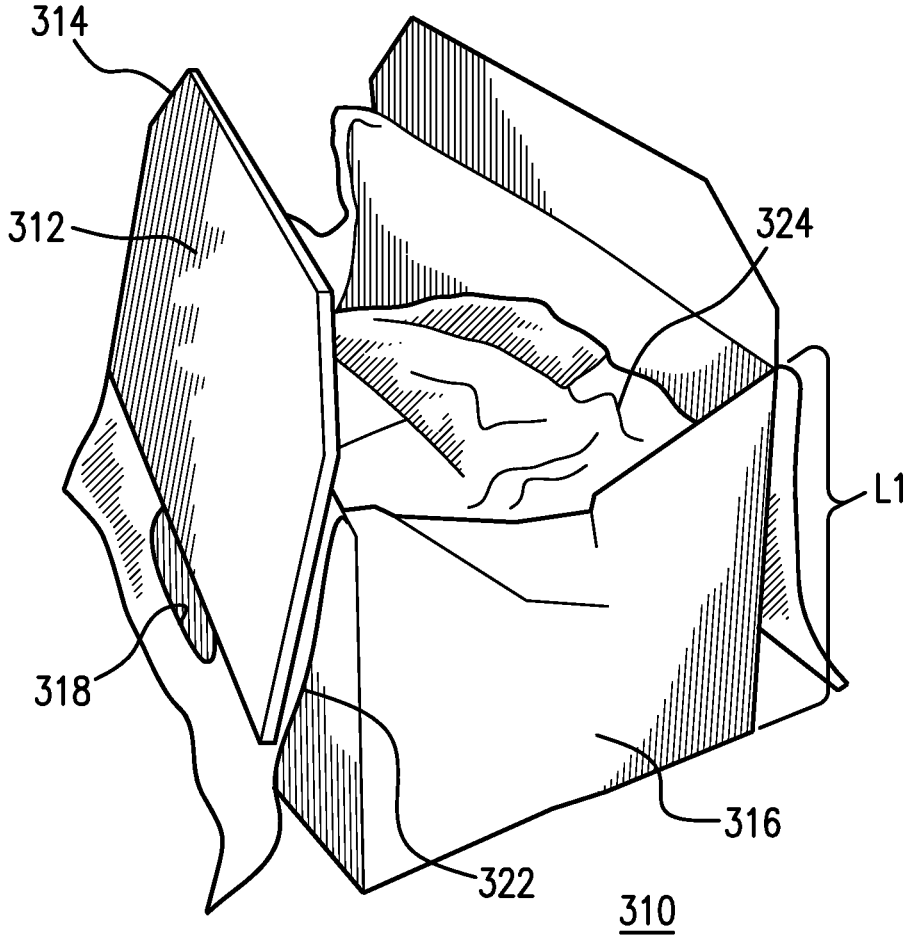
FIG. 3A is a perspective view of an example of a concealable double-scoop waste pick-up and storage device according to an embodiment of the present invention.
Figure 3B:
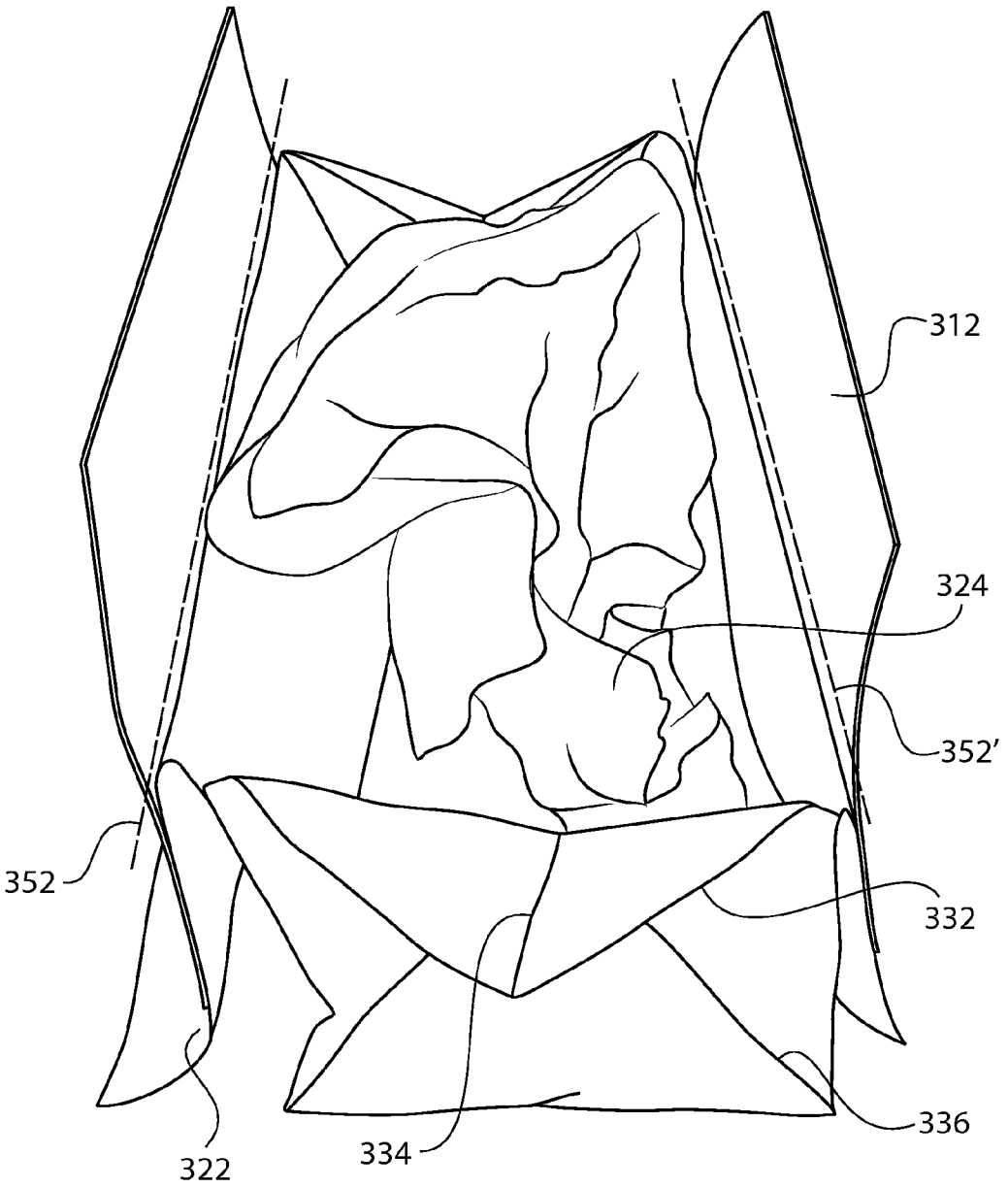
FIG. 3B is another perspective view of an example of a concealable double-scoop waste pick-up and storage device according to an embodiment of the present invention.
Figure 3C:
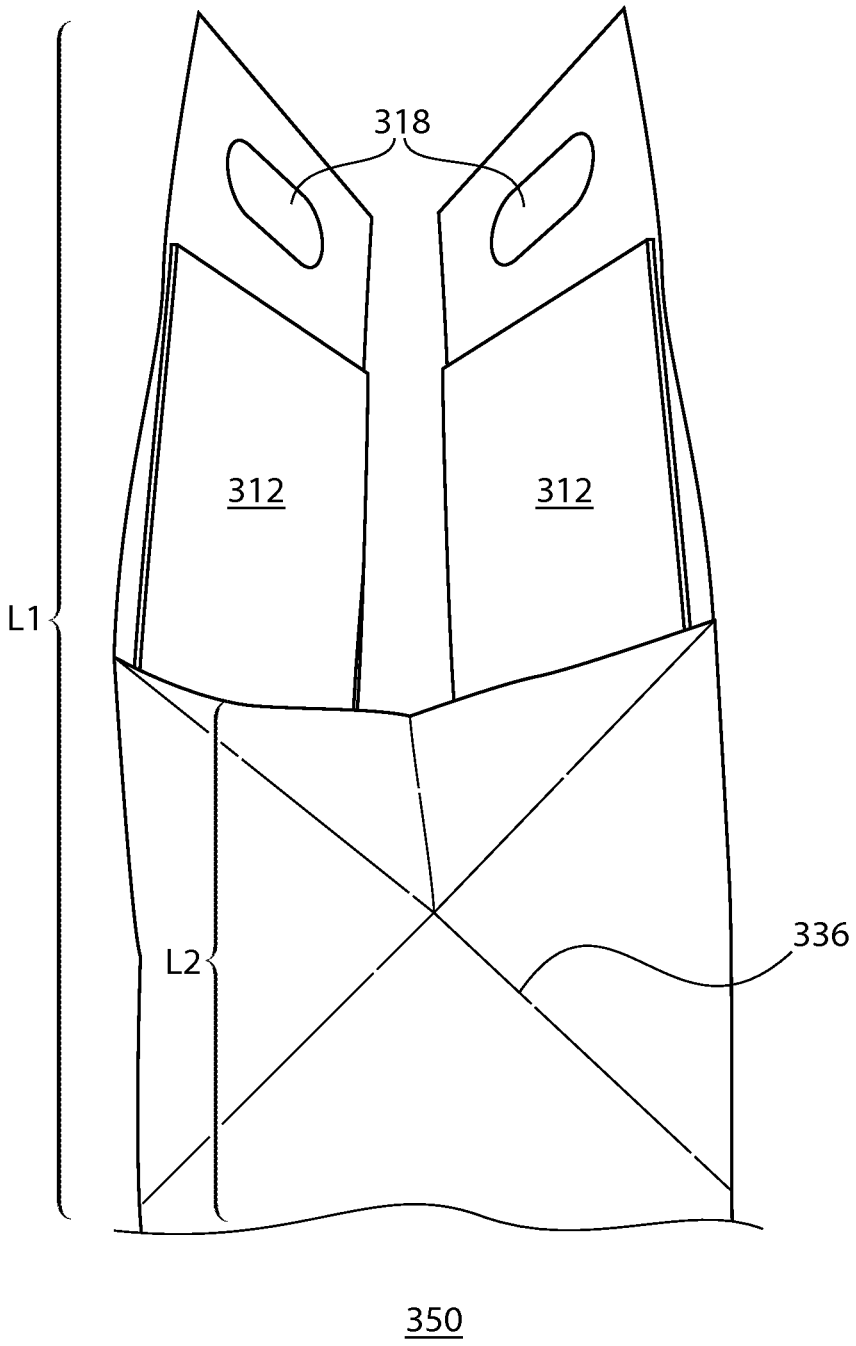
FIG. 3C is a side view of an example of a concealable double-scoop waste pick-up and storage device in a "storing" mode of operation according to an embodiment of the present invention.

FIGS. 3A to 3F show an example of a waste pick-up and storage device according to an embodiment of the present invention. The waste device of FIGS. 3A to 3F has features a receptacle 316, flaps 312, and chamfered edges 314. FIG. 3A is a perspective view 310 of an example of a concealable double-scoop waste pick-up and storage device according to an embodiment of the present invention. The receptacle 316 has a rectangular base that is capable of sitting on a surface without additional support. The receptacle 316 can be a conventional paper bag. The receptacle 316 has four sides wherein two sides have a length of L1 and two sides have a length of L2 measured from the rectangular base of the receptacle. L1 is greater than L2. The two taller sides having a length of L1 are situated opposite each other. The two shorter sides having a length of L2 are also situated opposite each other. In an embodiment, the two taller sides have cutouts (also referred to as "grips") 318 which are capable of being brought together to form a handle, as shown in FIG. 3C. The two taller sides each has a crease 352 and 352' (also functionally an axis of rotation), for folding the portion of the two taller sides protruding from the two shorter sides outwards. In an embodiment, the two taller sides are dimensioned such that when folded, the edges do not extend outward from the base. The two taller sides are reinforced by flaps 312. The flaps 312 are positioned such that a first portion rests on one side of the crease 352 and a second portion rests on the other side of the crease 352. The receptacle 316 can include reinforcement strips, to maintain a desired structure of a flexible receptacle. The reinforcement strips can be attached along the edges of the receptacle so as not to interfere with folding the receptacle flat.

The flaps 312 are attached in the position described above such that the portion resting on the side of the crease 352 that extends beyond the two short sides are fixedly attached to the receptacle 316 and the other portion is not attached. The flaps 312 can be fixedly attached to the receptacle 316 by adhesive or mechanical coupling. At least a portion of the flaps 312 can be attached to the receptacle 316 by any adhesives, including but not limited to glue, epoxy, and tape. At least a portion of the flaps 312 can be attached by a mechanical coupling. A mechanical coupling includes, but is not limited to, staples, hooks, closures, and other known fasteners. The adhesive or coupling can be determined by the materials of the receptacle 316 and/or the flaps 312. In an embodiment, the portion of the flaps 312 that is not attached has chamfered edges 314.

In the "waste pick-up" mode of operation, the flaps 312 are placed around the object 324 while the flaps 312 are positioned on the inside of the receptacle 316. The flaps 312 can be both rotated toward the opening of the receptacle 316 prior to use, such that the flaps protrude from the opening of the receptacle 316. The user can use the flaps 312 to sweep and/or scoop the litter onto the flaps 312, and rotate the flaps 312 towards the opening of the bag. The edges of the flaps 312 that are in contact with the object 324 and/or the surface upon which the object 324 is resting are then brought towards each other such that they are substantially contacting each other and supporting the object 324. The flaps 312 then rotate around the axis of rotation 352 and 352' towards the inside surface of the receptacle 316, such that the object 324 is pushed into the receptacle 316. The waste device can then be inverted or rotated into an upright position. The "storage" mode of operation the flaps 312 are positioned inside the receptacle 316 with the object 324 (not shown), as shown in FIG. 3C.

Figure 3D:
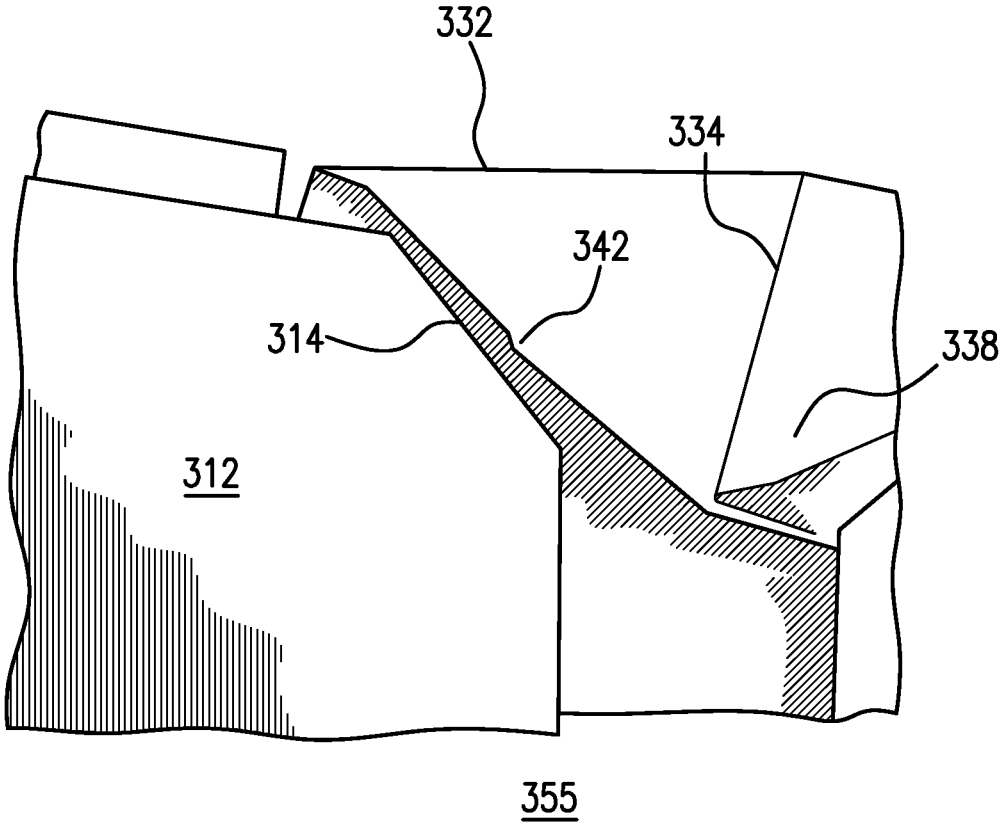
FIG. 3D is a top-down view of an example of a concealable double-scoop waste pick-up and storage device according to an embodiment of the present invention.
Figure 3E:
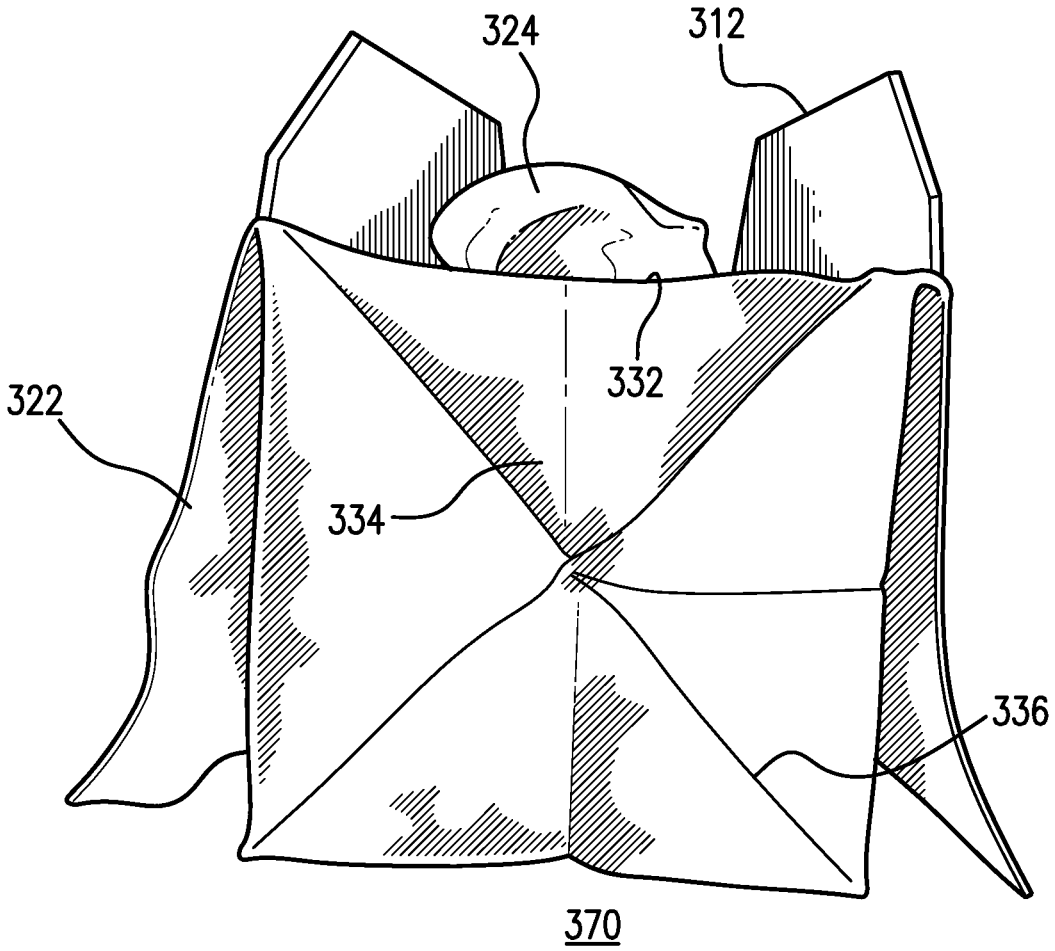
FIG. 3E is a side view of an example of a concealable double-scoop waste pick-up and storage device showing the creases on a side of the waste device according to an embodiment of the present invention.
Figure 3F:
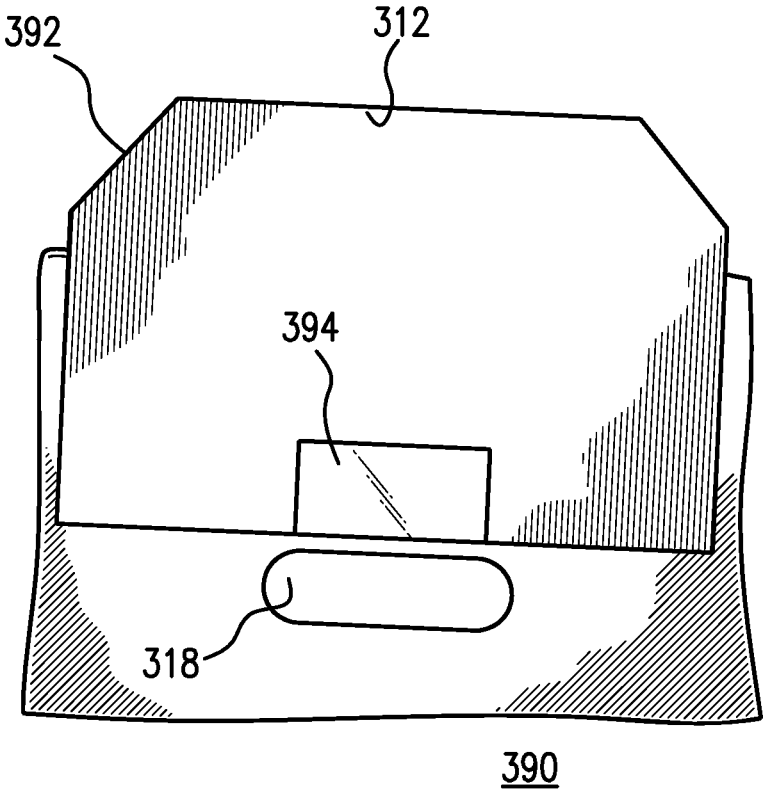
FIG. 3F shows a panel for scooping waste of an example of a concealable double-scoop waste pick-up and storage device according to an embodiment of the present invention.

FIG. 3B is another perspective view 330 of an example of a concealable double-scoop waste pick-up and storage device according to an embodiment of the present invention. FIG. 3C is a side view of the double-scoop waste pick-up and storage device. FIG. 3D is a top-down view showing a chamfered edge 314 of the flap 312 to fit in the v-shape formed by creases 334, 336, 338, and 342. FIG. 3E is a close-up side view 370 of an example of a concealable double-scoop waste pick-up and storage device in a "storing" mode of operation according to an embodiment of the present invention. FIG. 3F is a side view 370 of an example of a concealable double-scoop waste pick-up and storage device showing example of a creases 334, 336, 338, 342 on a shorter side of the waste device (L2) according to an embodiment of the present invention.

The side view 330 shows the creases on a shorter side of the receptacle 316 to assist in collapsing the receptacle 316 such that it lies flat. The two shorter sides of the receptacle 316 are symmetric and can have a first diagonal crease 336 that folds outwards away from the interior of the receptacle 316, a second diagonal crease 342 that folds outwards away from the interior of the receptacle 316, and a vertical crease 334 that folds downwards such that edge 332 forms a v-shape to prevent the flaps 312 from catching while transitioning from the "waste pick-up" and "storage" states, as shown in FIG. 3D. In an embodiment, the shorter sides each further include a horizontal crease 338 that only runs half-way across the side to permit the bottom of the bag to fold upwards when the receptacle 316 is stored in its flat state (not shown).

In a "storage" state, the taller sides 322 having a length of L2 can be brought together to close the container (as shown in side view 350). FIG. 3F shows a panel 312 for scooping waste of an example of a concealable double-scoop waste pick-up and storage device according to an embodiment of the present invention. In an embodiment, the taller sides 322 can be folded over to prevent spillage. In an embodiment, the taller sides 322 can be sealed by adhesive 394 to prevent spillage. In an embodiment, adhesive 394 can be tape with a removable cover strip, VELCRO, or other conventional methods for sealing containers when desired. In an embodiment, adhesive 394 is a strip shorter than the width of the flap (as shown). In an embodiment, adhesive 394 is a strip equal in length to the width of the flap (not shown). In an embodiment, the adhesive 394 is placed on the flap (as shown). In an embodiment, the adhesive is placed on an area of at least one of the taller sides 322.

Figure 4A:
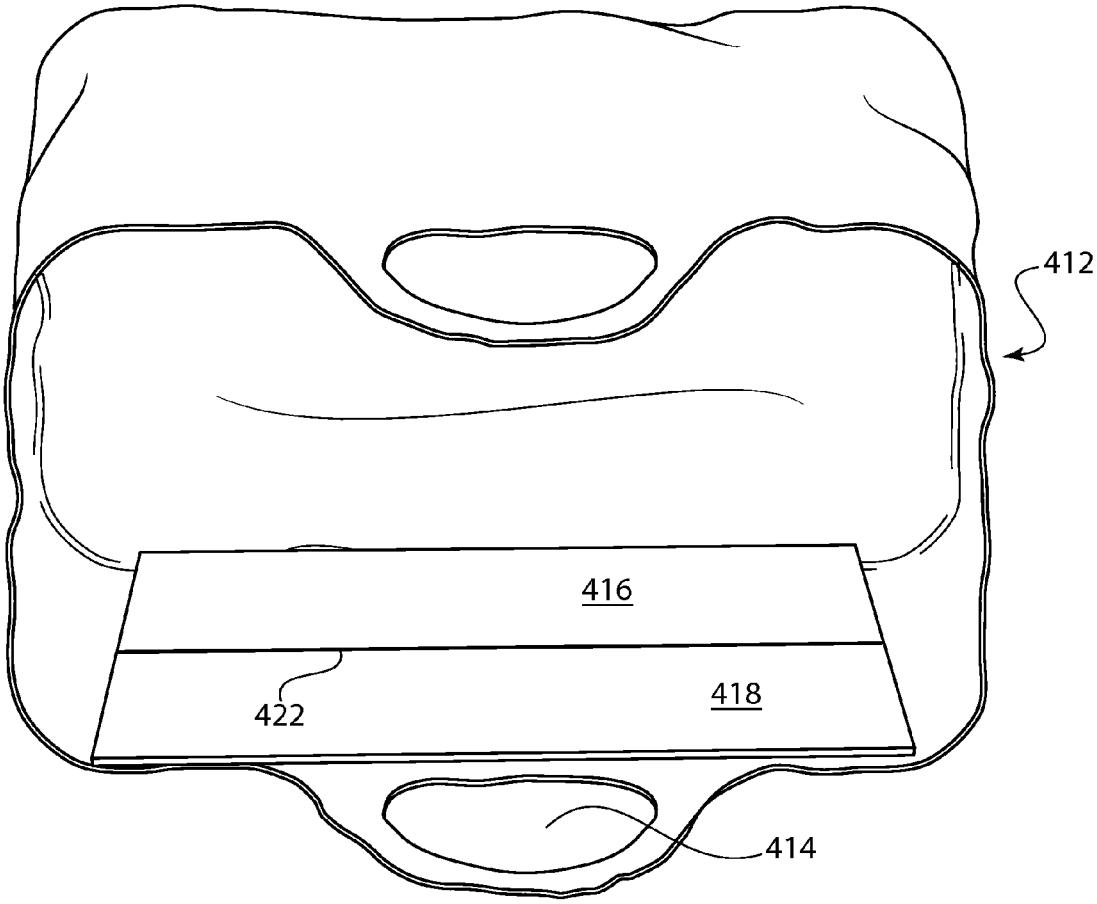
FIG. 4A is a perspective view of an example of a single-scoop waste pick-up and storage device according to an embodiment of the present invention.
Figure 4B:
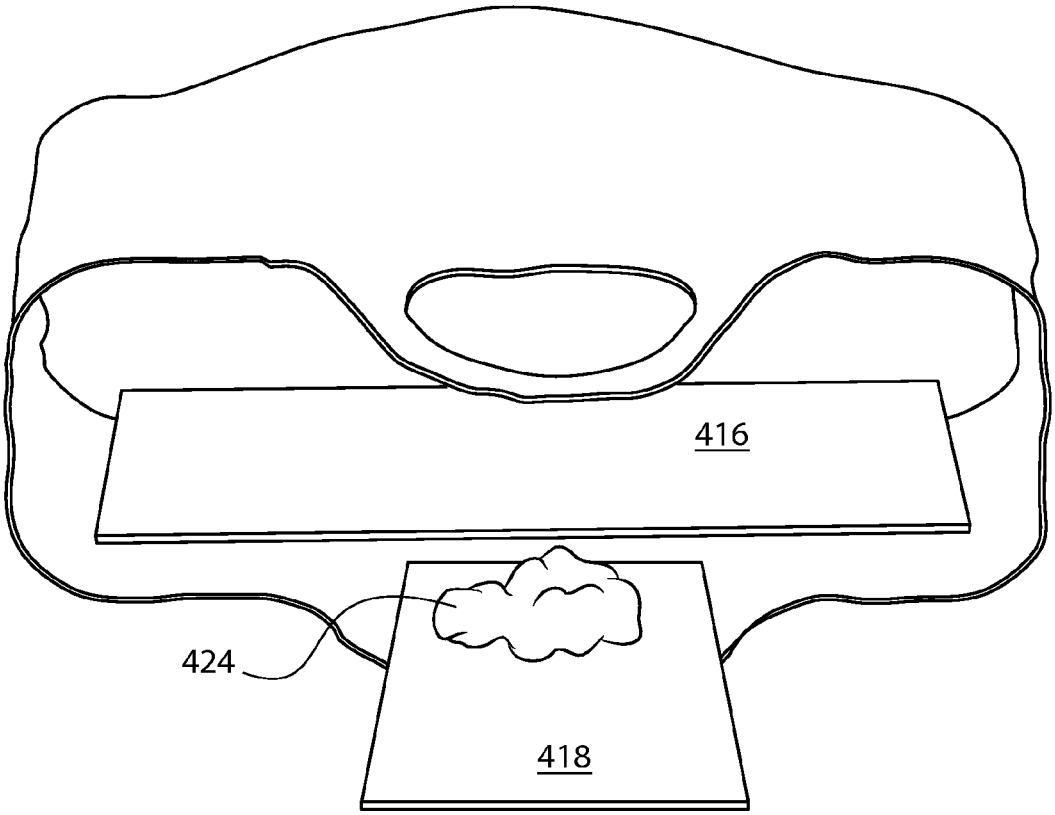
FIG. 4B is another perspective view of an example of a single-scoop waste pick-up and storage device in a "waste pick-up" mode of operation according to an embodiment of the present invention.

FIGS. 4A and 4B are views of an example of a single-scoop waste pick-up and storage device according to an embodiment of the present invention. FIG. 4A is a perspective view 410 of an example of a single-scoop waste pick-up and storage device according to an embodiment of the present invention. The waste device includes a receptacle 412 and a panel 416. The panel 416 can have a portion that is detachably connected via a line 422. In an embodiment, the line 422 is a perforation. The line 422 can be cut marks and/or a fold. In an embodiment, the device does not include a line 422. The user can remove a portion of the panel without a line 422. In an embodiment, a second panel 418 is separated from panel 416, such that the user can remove it from the receptacle prior to use. In an embodiment, the detachable portion can be detachably coupled to the panel 416. For example, another panel can join the panel 416 and detachable portion 418. A fasteners, such as a clip, staple, and other known fasteners can also join the panel 416 and detachable portion 418.

The panel 416 is positioned entirely inside the receptacle 412, and dimensioned such that it provides support for the receptacle 412. Panel 416 is at least substantially attached to the inside surface of receptacle 412, and can be attached with adhesive and/or mechanical coupling as described above. At least a portion of the panel 416 can be attached to the receptacle 412 by any adhesives, including but not limited to glue, epoxy, and tape. At least a portion of the panel 416 can be attached by a mechanical coupling. A mechanical coupling includes, but is not limited to, staples, hooks, closures, and other known fasteners. In an embodiment, the receptacle 412 has at least one handle 414. The user can tie the handles 414 together to seal the receptacle 412. In an embodiment, the receptacle 412 can have a drawstring for sealing after use. The drawstring can have two ends such that the user seals the receptacle by pulling the drawstrings in substantially opposite directions. In an embodiment, the drawstring can be a single, continuous string. The user can seal the bag by tying the drawing string. In an embodiment, the drawstring can have a mechanical joining, for example, a lockslide, twist tie, and/or other known fasteners to ensure the receptacle remains sealed.

FIG. 4B is another perspective view 450 of an example of a single-scoop waste pick-up and storage device in a "waste pick-up" mode of operation according to an embodiment of the present invention. In operation, the receptacle 412 is opened, and a scoop portion 418 of the waste device is detached from the panel 416. The scoop portion 418 can be oriented in any manner to sweep litter 424 into the receptacle 412. After the litter is scooped into the bag, the scoop portion 418 is placed inside the receptacle 412. In an embodiment, the receptacle 412 is closed to prevent spillage. In an embodiment, the receptacle 412 is closed by tying the opening. In an embodiment, the receptacle 412 having handles 414 is closed by tying the handle to each other. In an embodiment, receptacle 412 includes a drawstring positioned at or near the opening, such that the user can seal the receptacle using the drawstring, as described above.

The waste device of FIGS. 4A and 4B is "single-scoop" in the sense that a dedicated scoop can be formed from a detached portion 418 of the panel 416. For example, the portion remaining inside the receptacle 412 can be used as a scoop, because it is of a material sufficiently stiff to support the receptacle 412. In such an embodiment, the detached portion 418 can serve as a substantially fixed barrier to prevent litter 424 from traveling farther away from receptacle 412 while the user is using the panel 416 is scooping the litter 424.

Figure 5A:
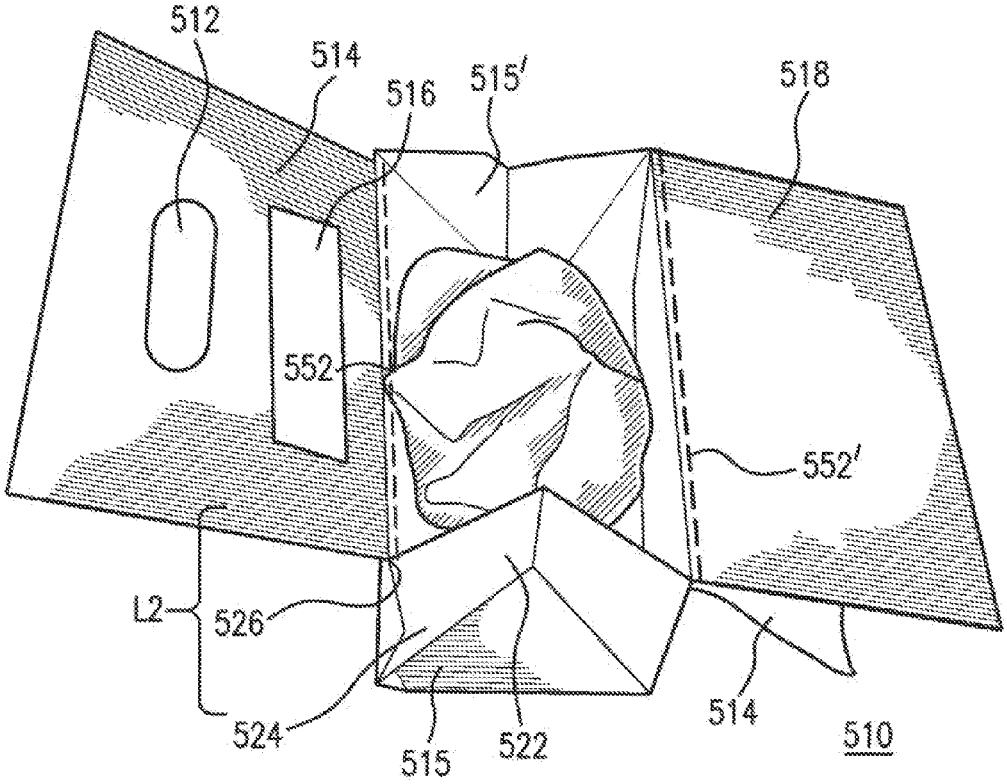
FIG. 5A is a perspective view of an example of a single-scoop waste pick-up and storage device according to an embodiment of the present invention.
Figure 5B:
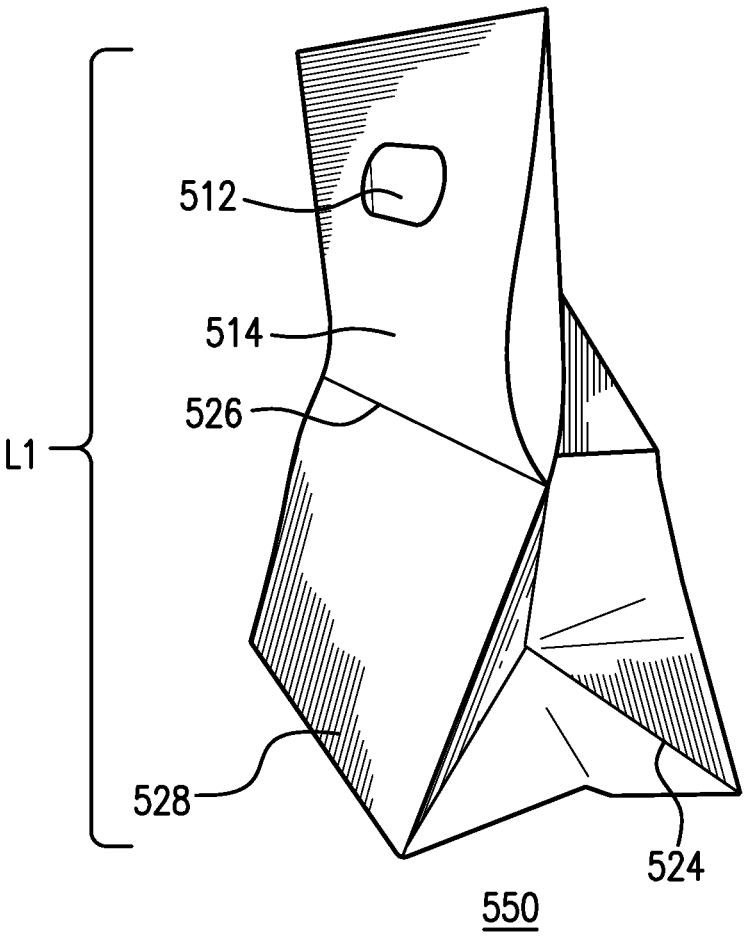
FIG. 5B is another perspective view of an example of a single-scoop waste pick-up and storage device according to an embodiment of the present invention.

FIGS. 5A and 5B show an example of a single-scoop waste pick-up and storage device according to an embodiment of the present invention. FIG. 5A is a perspective view 510 of an example of a single-scoop waste pick-up and storage device according to an embodiment of the present invention. The waste device of FIGS. 5A and 5B has features including a receptacle 522 and tall sides 514. FIG. 5A is a perspective view 510 of an example of a concealable single-scoop waste pick-up and storage device according to an embodiment of the present invention. The receptacle 522 has a rectangular base that is capable of sitting on a surface without additional support. The receptacle 522 can be a conventional paper bag. The receptacle 522 has four sides wherein two sides have a length of L1 and two sides have a length of L2 measured from the rectangular base of the receptacle. L1 is greater than L2. The two taller sides 514 having a length of L1 are situated opposite each other. The two shorter sides 515, 515' having a length of L2 are also situated opposite each other. In an embodiment, the two taller sides have cutouts (also referred to as "grips") 512 which are capable of being brought together to form a handle, as shown in FIG. 5B. The two taller sides each has a crease 552 and 552' (also functionally an axis of rotation), for folding the portion of the two taller sides protruding from the two shorter sides outwards. In an embodiment, the two taller sides are dimensioned such that when folded, the edges do not extend outward from the base.

In an embodiment, the waste device of FIGS. 5A and 5B includes a panel 518 having a detachable portion. The panel 518 is attached to a tall sides 514 such that it supports the tall side 514 to which it is fixedly attached. A detachable portion of the panel overlaps with at least a portion of the tall side 514 that extends beyond the shorter sides of the receptacle 522. The detachable portion can be attached to any location of the receptacle 522. The detachable portion can be attached by a removable adhesive. In an embodiment, the detachable portion can be attached to the surface of the receptacle by a removable adhesive. The detachable portion is removed from the adhesive when the receptacle is in waste pick-up mode. Remaining adhesive on the surface of the receptacle 522 can then be used to seal the receptacle after waste pick-up mode.

The panel 518 is positioned entirely inside the receptacle 522, and dimensioned such that it provides support for the receptacle 522. Panel 518 is at least substantially attached to the inside surface of receptacle 522, and can be attached with adhesive and/or mechanical coupling as described above. At least a portion of the panel 518 can be attached to the receptacle 522 by any adhesives, including but not limited to glue, epoxy, and tape. At least a portion of the panel 518 can be attached by a mechanical coupling. A mechanical coupling includes, but is not limited to, staples, clips, hooks, closures, and other known fasteners.

FIG. 5B is another perspective view 550 of an example of a single-scoop waste pick-up and storage device in a "storing" state according to an embodiment of the present invention. In an embodiment, in a "storing" mode, the taller sides 514 having a length of L1 can be brought together to close the container, as shown in FIG. 5B. In an embodiment, the taller sides 514 can be folded over to prevent spillage. In an embodiment, the taller sides 514 can be sealed to prevent spillage. In an embodiment, the receptacle can be sealed by adhesives or mechanical couplings. In an embodiment, an adhesive can be tape with a removable cover strip, VELCRO, or other conventional methods for sealing containers when desired. The receptacle 522 can be sealed by any adhesives, including but not limited to glue, epoxy, and tape. At least a portion of the panel 518 can be attached by a mechanical coupling. A mechanical coupling includes, but is not limited to, staples, clips, hooks, closures, and other known fasteners.

Figure 6A:
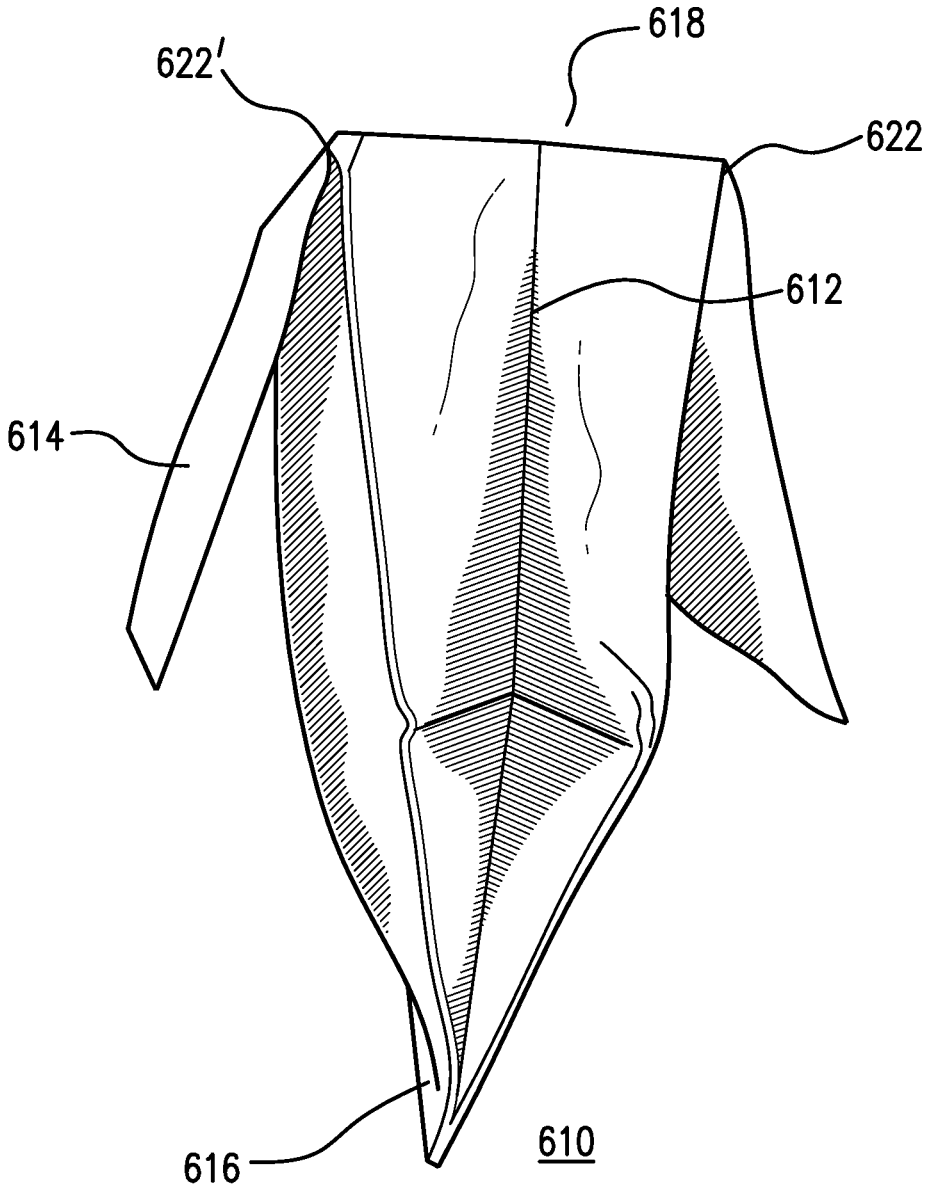
FIG. 6A is a side view of a compact example of a single-scoop waste pick-up and storage device according to an embodiment of the present invention.
Figure 6B:
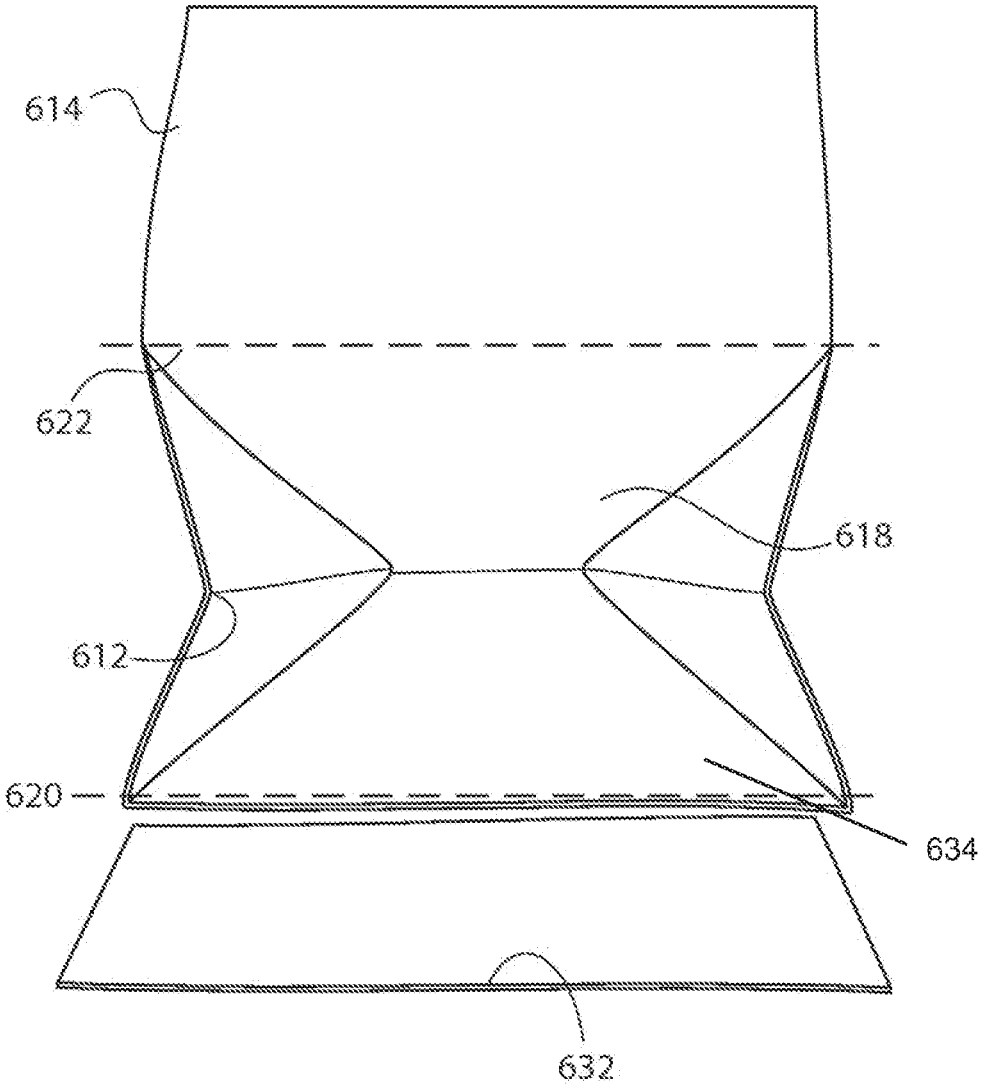
FIG. 6B is a top-down view of the interior of a compact example of a single-scoop waste pick-up and storage device according to an embodiment of the present invention.
Figure 6C:
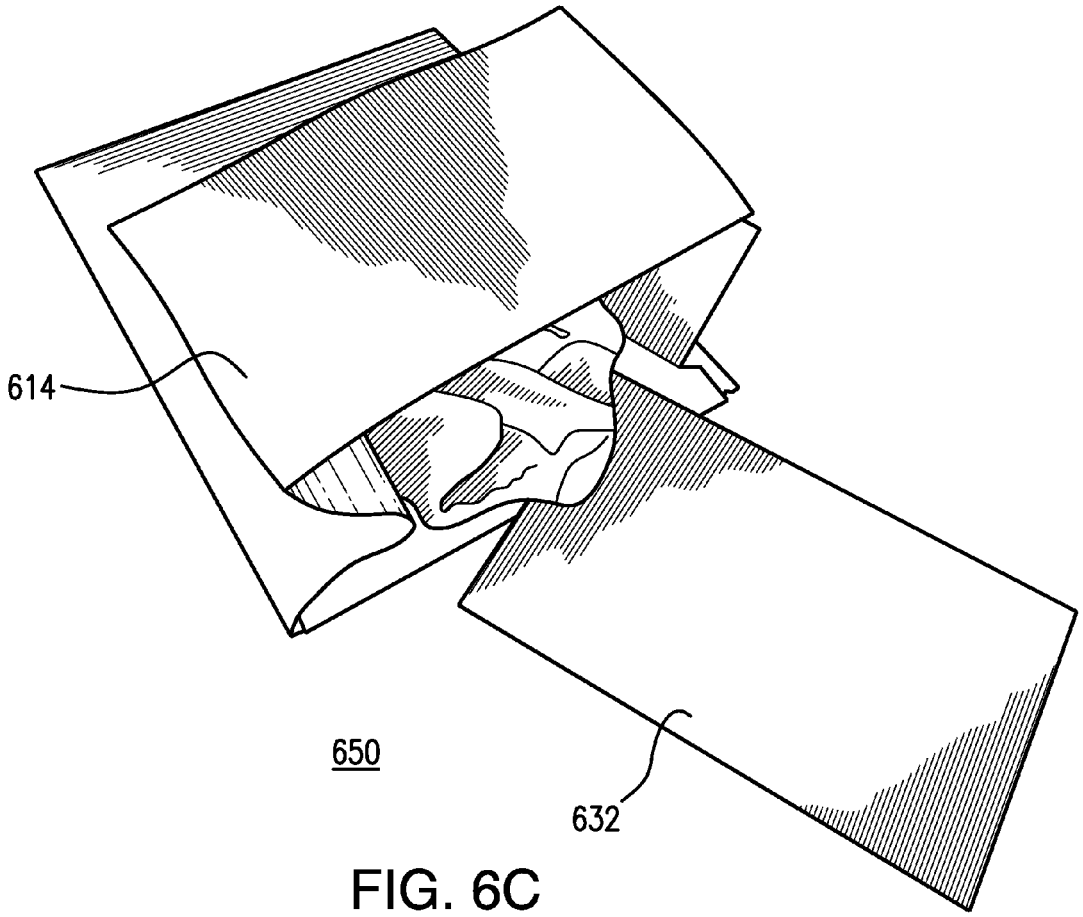
FIG. 6C is a perspective view of a compact example of a single-scoop waste pick-up and storage device in a "waste pick-up" mode of operation according to an embodiment of the present invention.

FIGS. 6A to 6C show an example of a single-scoop waste pick-up and storage device according to an embodiment of the present invention. FIG. 6A is a side view 610 of a compact example of a single-scoop waste pick-up and storage device according to an embodiment of the present invention. The waste device of FIGS. 6A to 6C can be characterized as especially compact, because in its flattened and/or folded state, there are only two layers of material as compared with at least four layers in a rectangular-bottomed receptacle, for example, a paper bag. The waste device of FIGS. 6A to 6C includes the features of a receptacle 618 and taller sides 614.

FIG. 6A is a perspective view 610 of an example of a single-scoop waste pick-up and storage device according to an embodiment of the present invention. The waste device includes a receptacle 610 and a panel 634. The panel 634 can have a portion that is detachably connected via a line 620. In an embodiment, the line 620 is a perforation. The line 620 can be cut marks and/or a fold. In an embodiment, the device does not include a line 620. The user can remove a portion of the panel without a line 620. In an embodiment, a second panel 632 is separated from panel 634, such that the user can remove it from the receptacle prior to use. In an embodiment, the detachable portion 632 can be detachably coupled to the panel 634. For example, another panel can join the panel 634 and detachable portion 632. Fasteners, such as clips, staples, and other known fasteners can also joint eh panel 634 and detachable portion 632.

The panel 634 is positioned entirely inside the receptacle 610, and dimensioned such that it provides support for the receptacle 610. Panel 634 is at least substantially attached to the inside surface of receptacle 610, and can be attached with adhesive and/or mechanical coupling as described above. At least a portion of the panel 634 can be attached to the receptacle 610 by any adhesives, including but not limited to glue, epoxy, and tape. At least a portion of the panel 634 can be attached by a mechanical coupling. A mechanical coupling includes, but is not limited to, staples, hooks, closures, and other known fasteners.

A detachable portion of the panel overlaps with at least a portion of the tall side 614 that extends beyond the shorter sides of the receptacle 610. A wing can be a portion of the tall side 614 extending from the side of the opening. The tall sides can have a wing extending from the side of the opening. In an embodiment, the detachable panel 632 is not attached to the inner surface of the receptacle and coincides at least in part with the first wing. The detachable portion can be attached to any location of the receptacle 610. In some an embodiment, the detachable portion can be attached by a removable adhesive. In an embodiment, the detachable portion can be attached to the surface of the receptacle by a removable adhesive. The detachable portion is removed from the adhesive when the receptacle is in waste pick-up mode. Remaining adhesive on the surface of the receptacle 610 can then be used to seal the receptacle after waste pick-up mode.

FIG. 6B is a top-down view 630 of the interior of a compact example of a single-scoop waste pick-up and storage device according to an embodiment of the present invention. FIG. 6C is a perspective view 650 of a compact example of a single-scoop waste pick-up and storage device in a "waste pick-up" mode of operation according to an embodiment of the present invention. In an embodiment, the receptacle 610 has a seam 616 that joins two sides of the receptacle to form a bottom and two creases 612, located on the two shorter sides of the receptacle 618 when folded along the crease 612, the longitudinal center of the shorter side extends into the receptacle, while the edges remain fixed to the adjacent sides. Thus, the receptacle is capable of being folded flat along the creases 612. In an embodiment the two taller sides 614 of the receptacle each has a crease 622 for folding down the flaps 614. In a storage state, the flaps are foldable to prevent spillage of the contents of the receptacle 618.

FIG. 6C is a perspective view 650 of an example of a single-scoop waste pick-up and storage device in a "waste pick-up" mode of operation according to an embodiment of the present invention. In operation, the receptacle 610 is opened, and a scoop portion 632 of the waste device is detached from the panel 634. The scoop portion 632 can be oriented in any manner to sweep litter into the receptacle 610. After the litter is scooped into the receptacle, the scoop portion 632 is placed inside the receptacle 610. In an embodiment, the receptacle 610 is closed to prevent spillage. In an embodiment, the receptacle 610 is sealed.

In an embodiment, in a "storing" mode, the taller sides 614 can be brought together to close the container. In an embodiment, the taller sides 614 can be folded over to prevent spillage. In an embodiment, the taller sides 614 can be sealed to prevent spillage. In an embodiment, the receptacle can be sealed by adhesives or mechanical couplings. In an embodiment, an adhesive can be tape with a removable cover strip, VELCRO, or other conventional methods for sealing containers when desired. The receptacle 610 can be sealed by any adhesives, including but not limited to glue, epoxy, and tape. The receptacle can be sealed by a mechanical coupling. A mechanical coupling includes, but is not limited to, staples, clips, hooks, closures, and other known fasteners.

FIGS. 7A to 7G show an example of a waste pick-up and storage device according to an embodiment of the present invention. A waste pick-up and storage device can require the user to utilize two hands to pick-up and store litter. Another embodiment requires only one hand to pick up and store litter. This can be advantageous, for example, for a pet owner holding onto a leash with one hand. A one-handed waste pick-up and storage device can be made out of paper and/or plastic and/or metal, and any combination thereof.

Figure 7A:
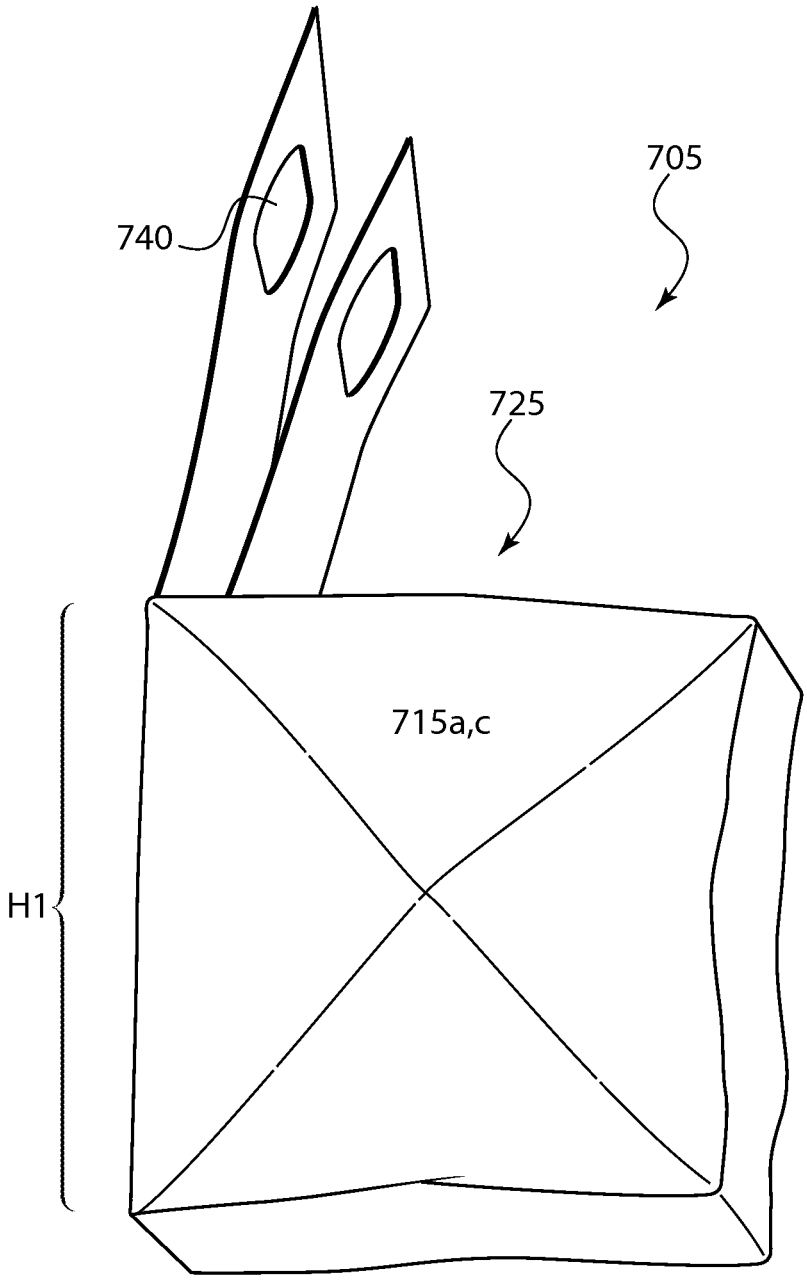
FIG. 7A is a side view of an example of a single-handed waste pick-up and storage device according to an embodiment of the present invention.
Figure 7B:
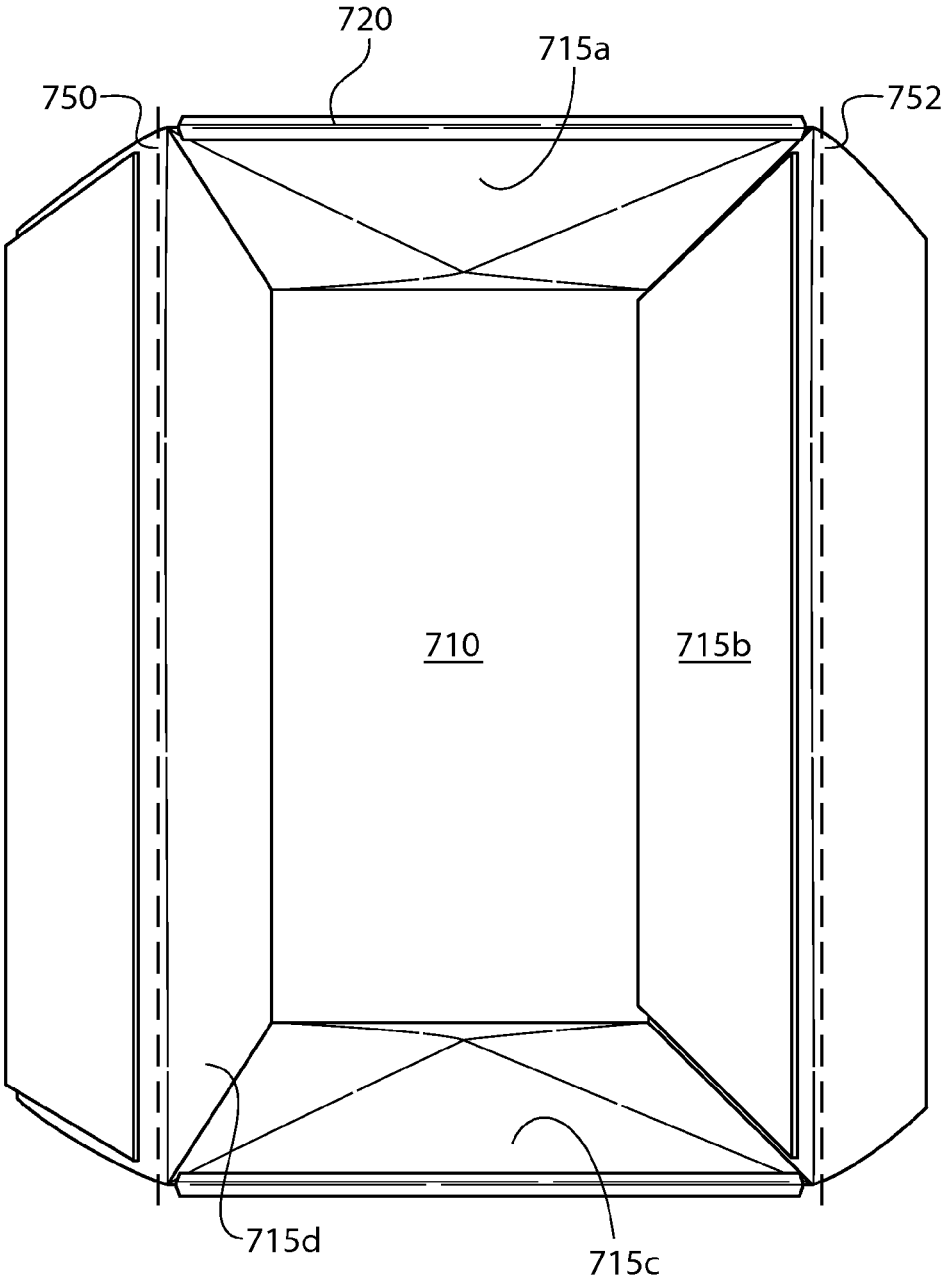
FIG. 7B is a top-down view of an example of a single-handed waste pick-up and storage device according to an embodiment of the present invention.
Figure 7C:
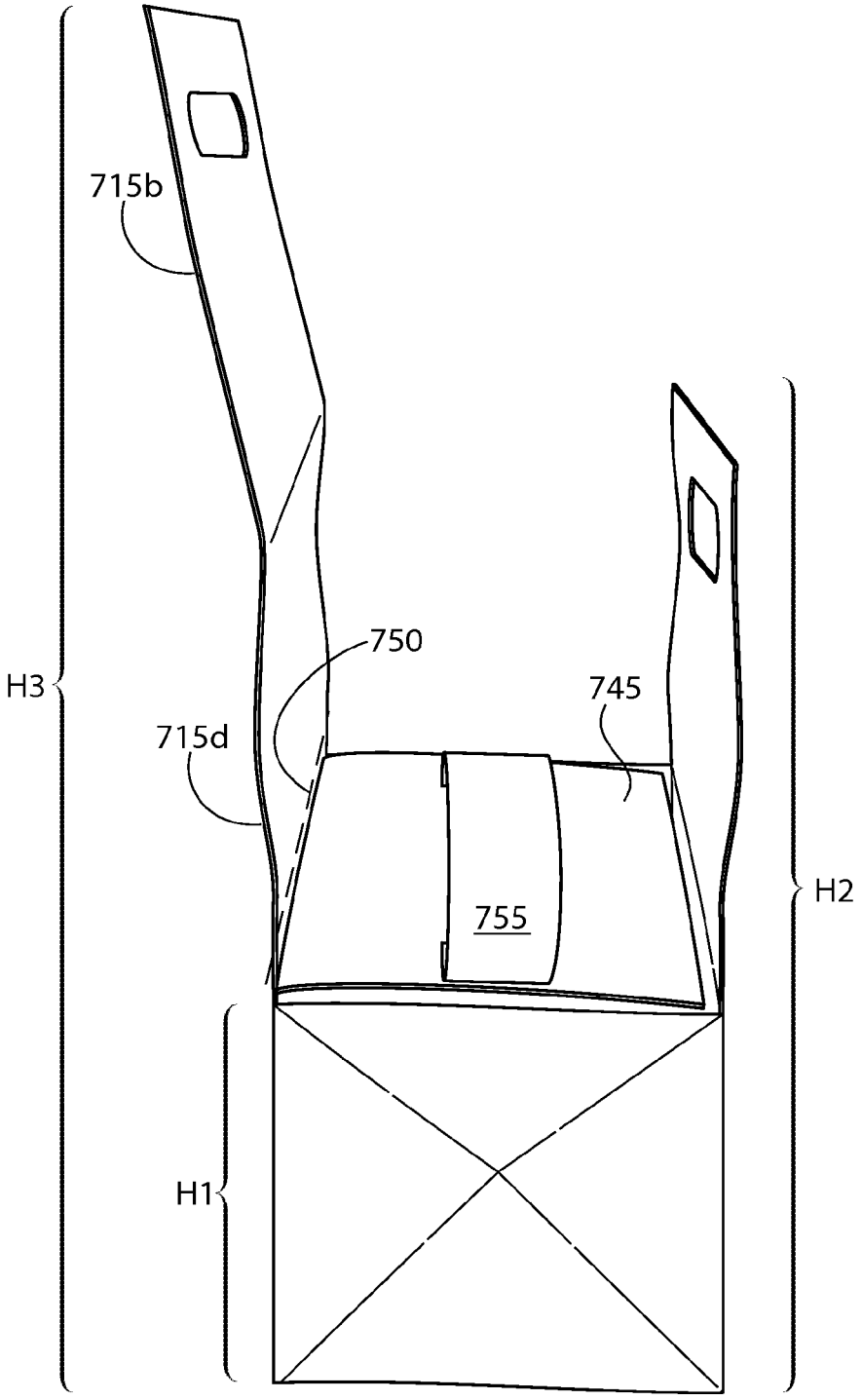
FIG. 7C is another side view of an example of a single-handed waste pick-up and storage device according to an embodiment of the present invention.

FIG. 7A shows a side view of an embodiment 700 having a receptacle 705. FIG. 7B shows a top-down view 760 of the receptacle 705. FIG. 7C shows another side view 765 of the sides of the receptacle 705. The receptacle 705 can be formed out of paper, for example, a conventional paper bag. The receptacle 705 can be at least partially flexible. The receptacle 705 can be folded flat for convenient storage (not shown). The receptacle 705 has a rectangular base 710, four sides 715*a* to 715*d*, and an opening 720. Sides 715*a* and 715*c* have a height (H1) measured from the rectangular base 710. Side 715*b* has a height (H2) measured from the rectangular base 710. Side 715*d* has a height (H3) measured from the rectangular base 710. The height of the sides 715*a* to 715*d* can be at least a minimum height to form a box 725.

Figure 7D:
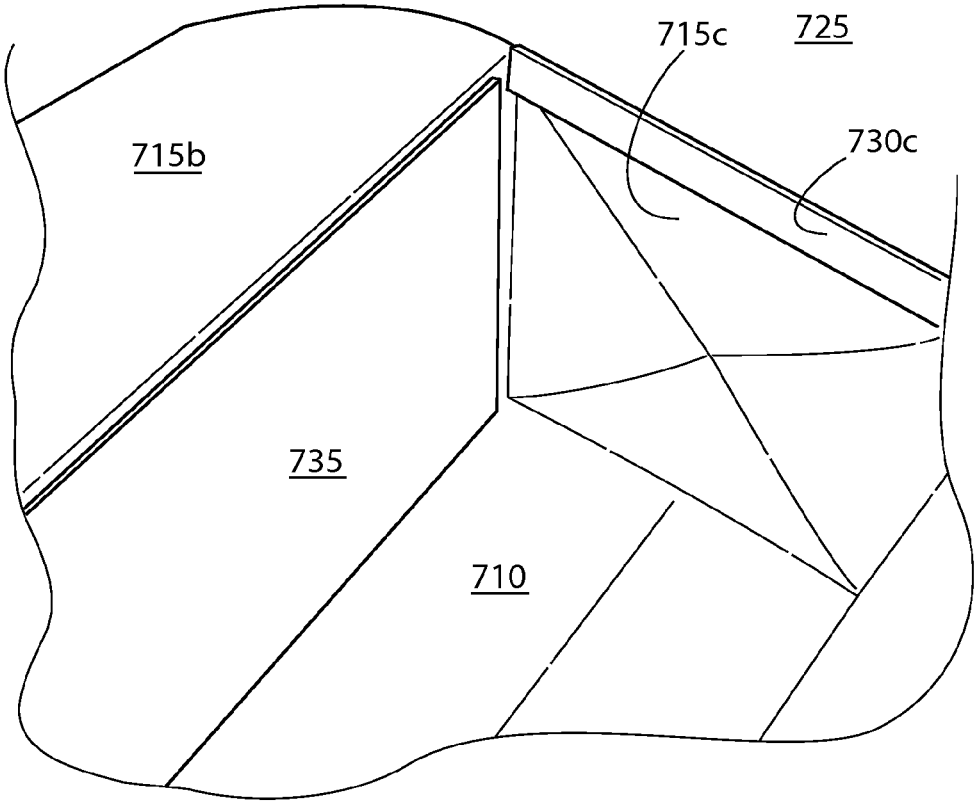
FIG. 7D is a perspective view of an example of a single-handed waste pick-up and storage device according to an embodiment of the present invention.

FIG. 7D shows a perspective view 770 of the inner surface of the box 725. The box 725 can be reinforced on sides 715*a* and 715*c* to prevent receptacle collapse. Reinforcement strips 730*c* are attached at the edge of the box 725, opposite the rectangular base 710 on sides 715*a* and 715*c*. The reinforcement strips 730*c* can be attached substantially parallel along the edge of the box 725 and substantially perpendicular to sides 715*b* and 715*d*. The reinforcement strips 730*c* can be made from inflexible material, for example, cardboard or hard plastic.

Figure 7E:
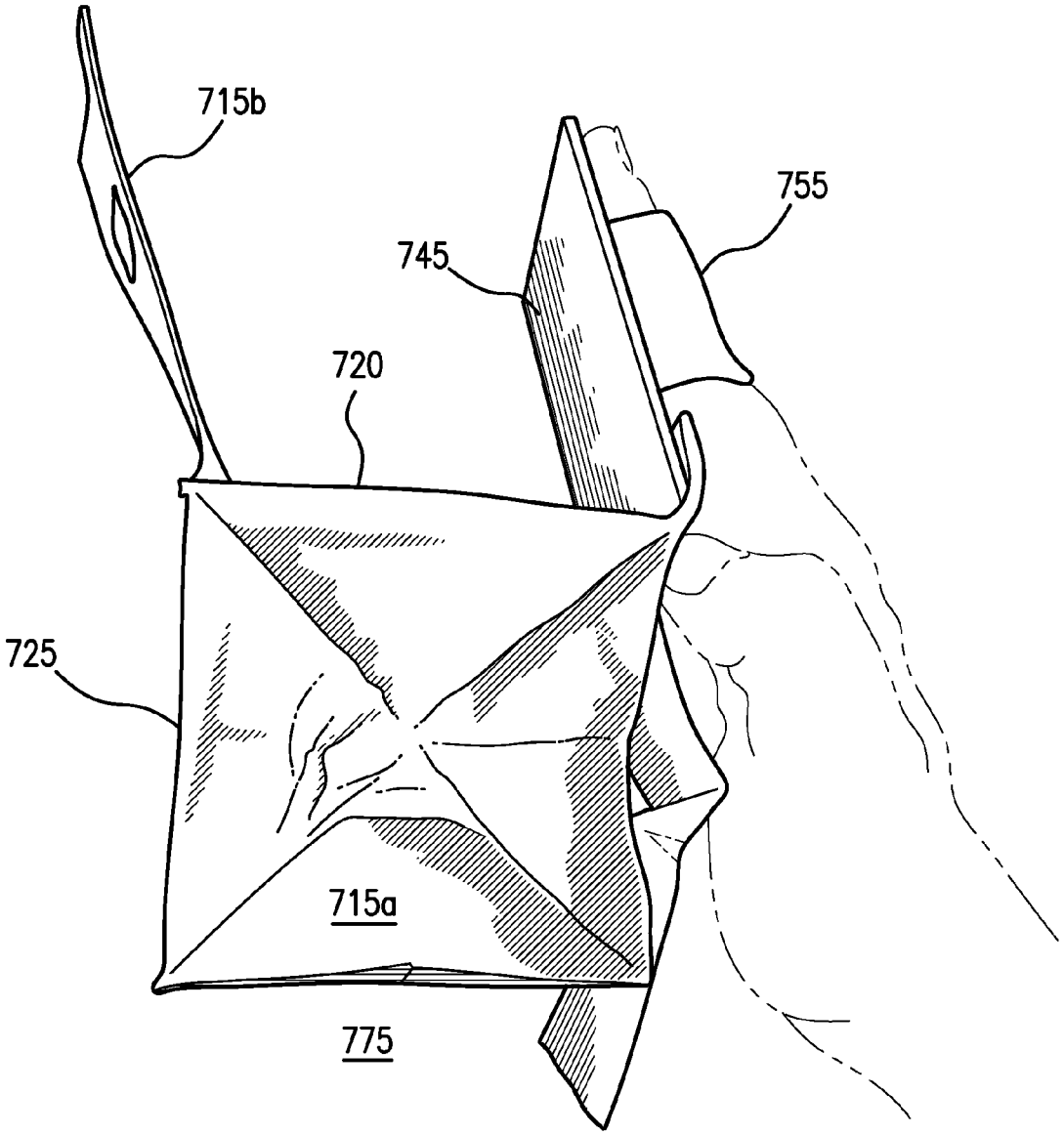
FIG. 7E is a side view of an example of a single-handed waste pick-up and storage device according to an embodiment of the present invention in waste pick-up mode.
Figure 7F:
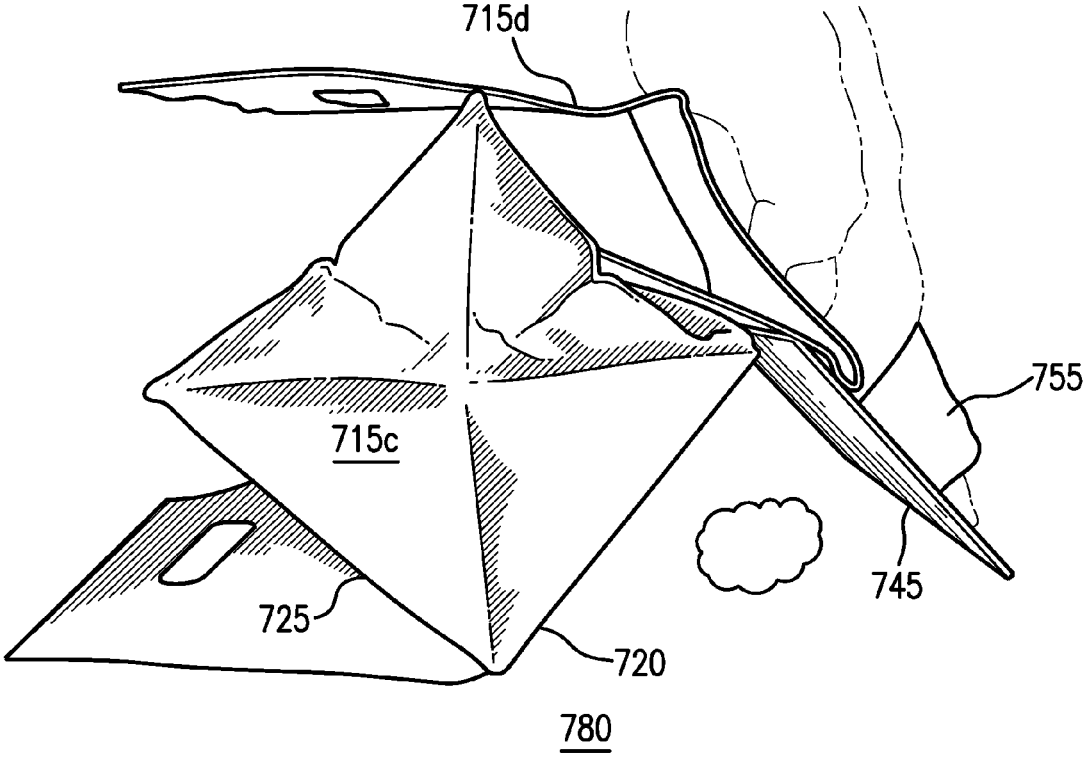
FIG. 7F is another side view of an example of a single-handed waste pick-up and storage device according to an embodiment of the present invention in waste pick-up mode.

A first portion of side 715*b* can be reinforced with a panel 735. Panel 735 can be equal in height (H1) to sides 715*a* and 715*c*. Panel 735 is at least partially attached to side 715*b*, and can be completely attached by adhesive and/or known mechanical couplings. At least a portion of the panel 735 can be attached by any adhesives, including but not limited to glue, epoxy, and tape. At least a portion of the panel 735 can be attached by a mechanical coupling. A mechanical coupling includes, but is not limited to, staples, clips, hooks, closures, and other known fasteners. A second portion of side 715*b* can extend further from height H1 to height H2. The second portion of side 715*b* can be flexible and rotatable around axis 752. Side 715*b* can be rotatable around axis 752 so as not to interfere with the user when the device is in waste pick-up mode, for example, as shown in FIG. 7F and described below. Panel 735 can be inflexible, to prevent receptacle collapse. For example, panel 735 can made of cardboard or hard plastic. The second portion of side 715*b* can have cutouts, or grips 740, as shown in FIG. 7A.

Side 715*d* can have a panel 745 at least partially attached to a portion at or above height H1 on side 715*d*. For example, panel 745 can be a flap, or lid. Panel 745 can rotate around an axis of rotation 750 to cover the opening 720 of the receptacle 705, as shown in FIG. 7C. The axis of rotation 750 is substantially parallel to side 715*d*, is perpendicular to sides 715*a* and 715*c*, and is located at height H1 of the box 725. Panel 745 can be made from inflexible material, for example, cardboard and/or hard plastic. Panel 745 can have chamfered edges. In an embodiment, panel 745 has scalloped, and/or rounded edges. Panel 745 can include a device to allow the user to prevent the panel 745 from closing when the device is in waste pick-up mode. For example, the device can be a handle, bracelet, wristlet, glove, mitten, and/or strap 755 attached to a surface. A strap 755 can be attached to the surface of the panel 745 facing outward of the box 725 as shown in FIG. 7C. The strap 755 can be attached at each end of the panel, substantially parallel to sides 715*a* and 715*c*. For example, strap 755 allows a user to slide it over a hand so that the pet owner can single-handedly scoop up litter or pet waste, as shown in FIG. 7E. FIG. 7E shows a side view 775 of a user opening the box 725 of the receptacle 705. Panel 745 is partially attached to side 715*d* so that it is rotatable around axis 750, such that side 715*d* does not interfere with the user's hand. Strap 755 can also be enclosed on one end to form a protective glove or shield of a user's hand (not shown).

FIG. 7F is a side view 780 of the single-handed waste pick-up and storage device in pick-up mode. The panel 745 simultaneously acts as a cover for the box as well as a scoop to insert litter into the box 725. When the receptacle 705 is in pick-up mode, the user can invert the receptacle 705 with one hand. As shown in FIG. 7F, the inverted box 725 and panel 745 can surround the waste, and the user can sweep the waste into the opening 720 of the box 725. Side 715*d* has a height H3, longer than H2 and H1. In an embodiment, sides 715*a* and/or 715*c* can have a mechanism to allow a user's thumb to ensure the box remains open when inverted (not shown). For example, a hook, loop, ledge, lip, and other known protrusions allows a user to maintain the opening when the receptacle is in waste pick-up mode. A hook, loop and/or other known protrusions can be a protrusion that encompasses a user's thumb to allow the user to manipulate the receptacle and counteract the force of gravity when the receptacle is inverted. Similarly, a ledge, lip, and other known protrusions can be a protrusion that has a surface upon which the user can apply a force to counteract the force of gravity.

Figure 7G:
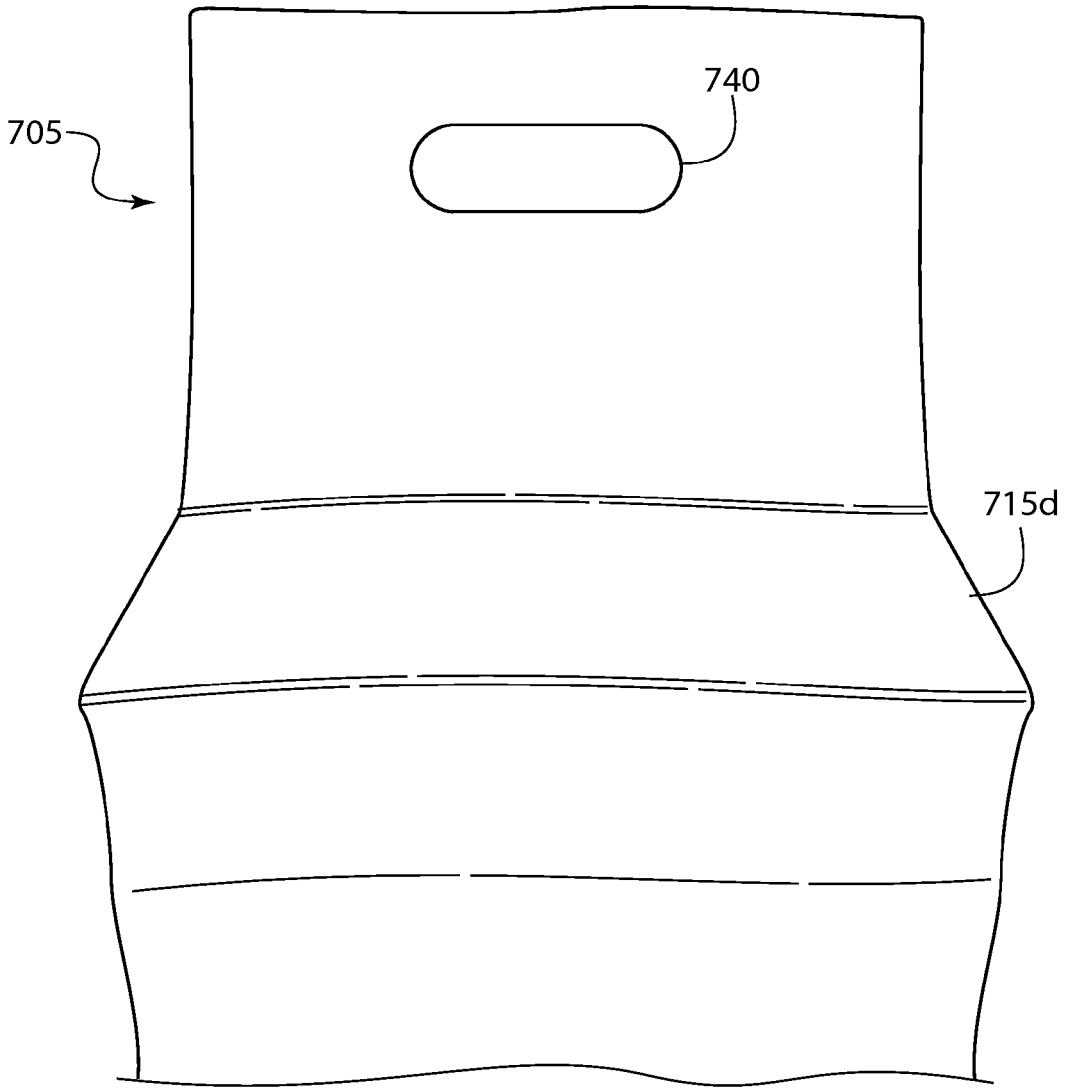
FIG. 7G is a front view of an example of a single-handed waste pick-up and storage device according to an embodiment of the present invention in storage mode.

FIG. 7G is a front view 785 of receptacle 705 in storage mode. Side 715*d* has a height of H3, longer than side 715*b*, having a height of H2, and sides 715*a* and 715*c*, each having heights of H1. The additional height on side 715*d* allows the panel 745 to be covered by a portion of 715*d* after pick-up and when the receptacle is in storage mode. Side 715*d* has cutouts, or grips 740, positioned to match the grip 740 positioned on side 715*b*.

The receptacle can be formed using various means, including but not limited to adhesives and mechanical couplings. In an embodiment, the receptacle can be formed by thermal joining of materials. Examples of adhesives include but are not limited to glue, tape, and epoxy. Examples of mechanical couplings include but are not limited to staples, clips, and other known fasteners.

Figure 8A:
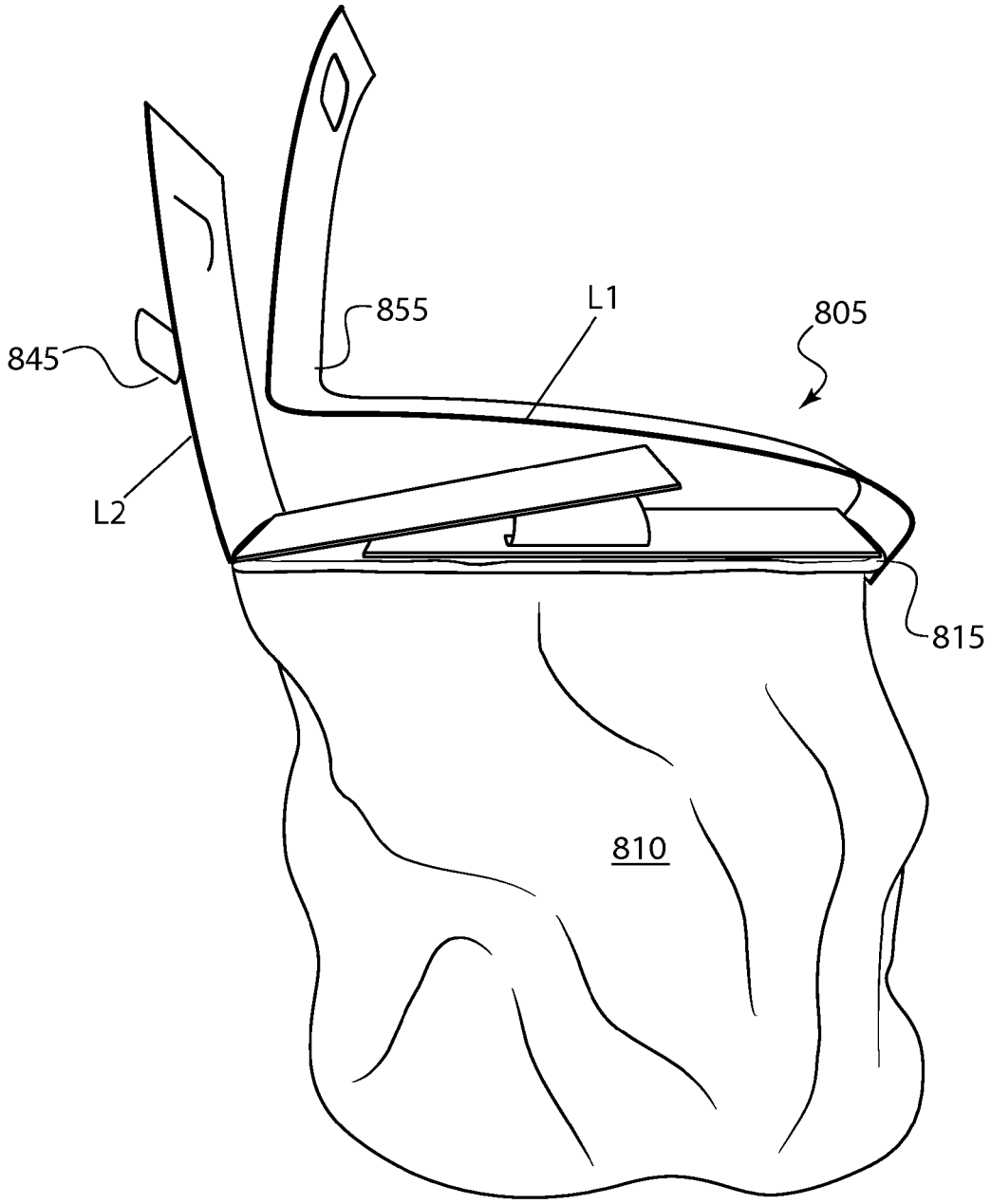
FIG. 8A is a side view of an example of a single-handed waste pick-up and storage device according to an embodiment of the present invention.
Figure 8B:
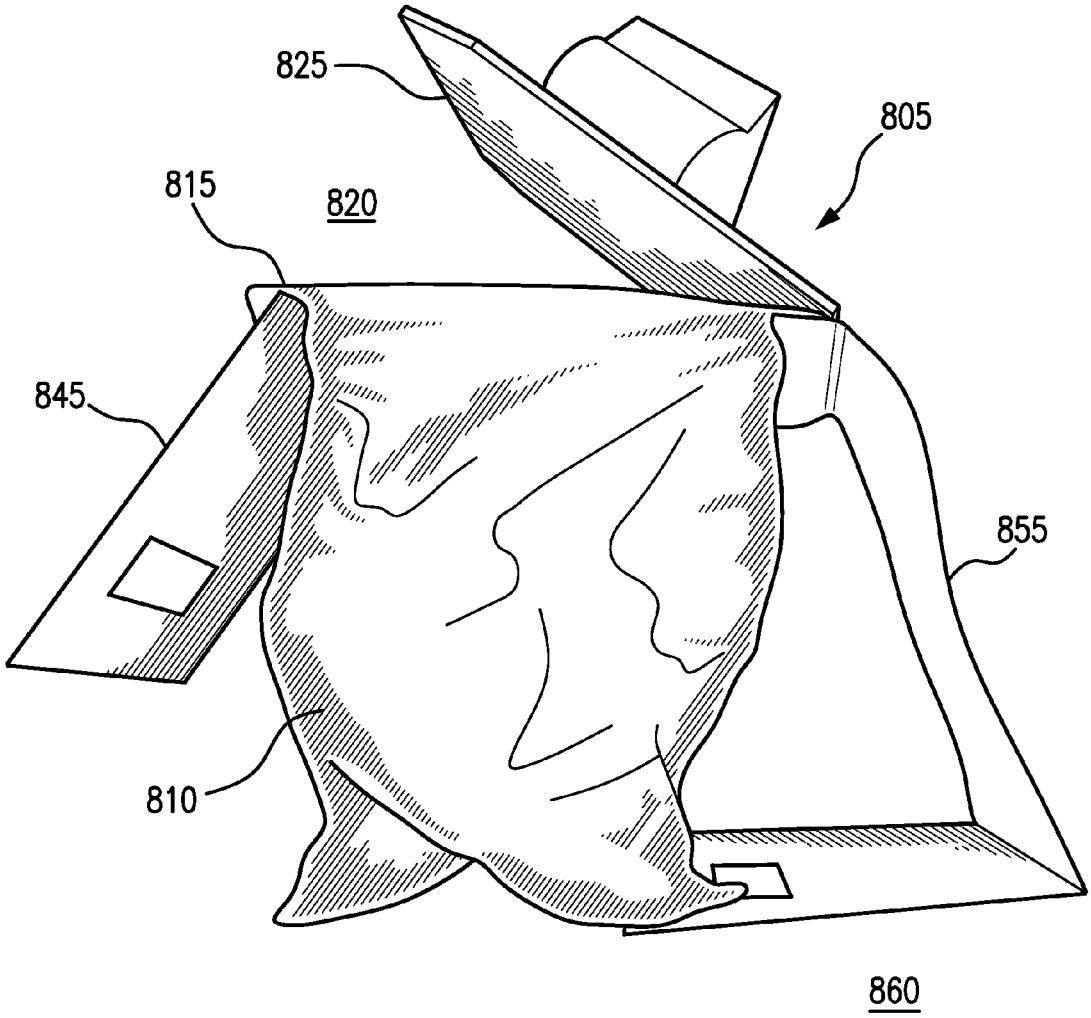
FIG. 8B is another side view of an example of a single-handed waste pick-up and storage device according to an embodiment of the present invention.
Figure 8C:
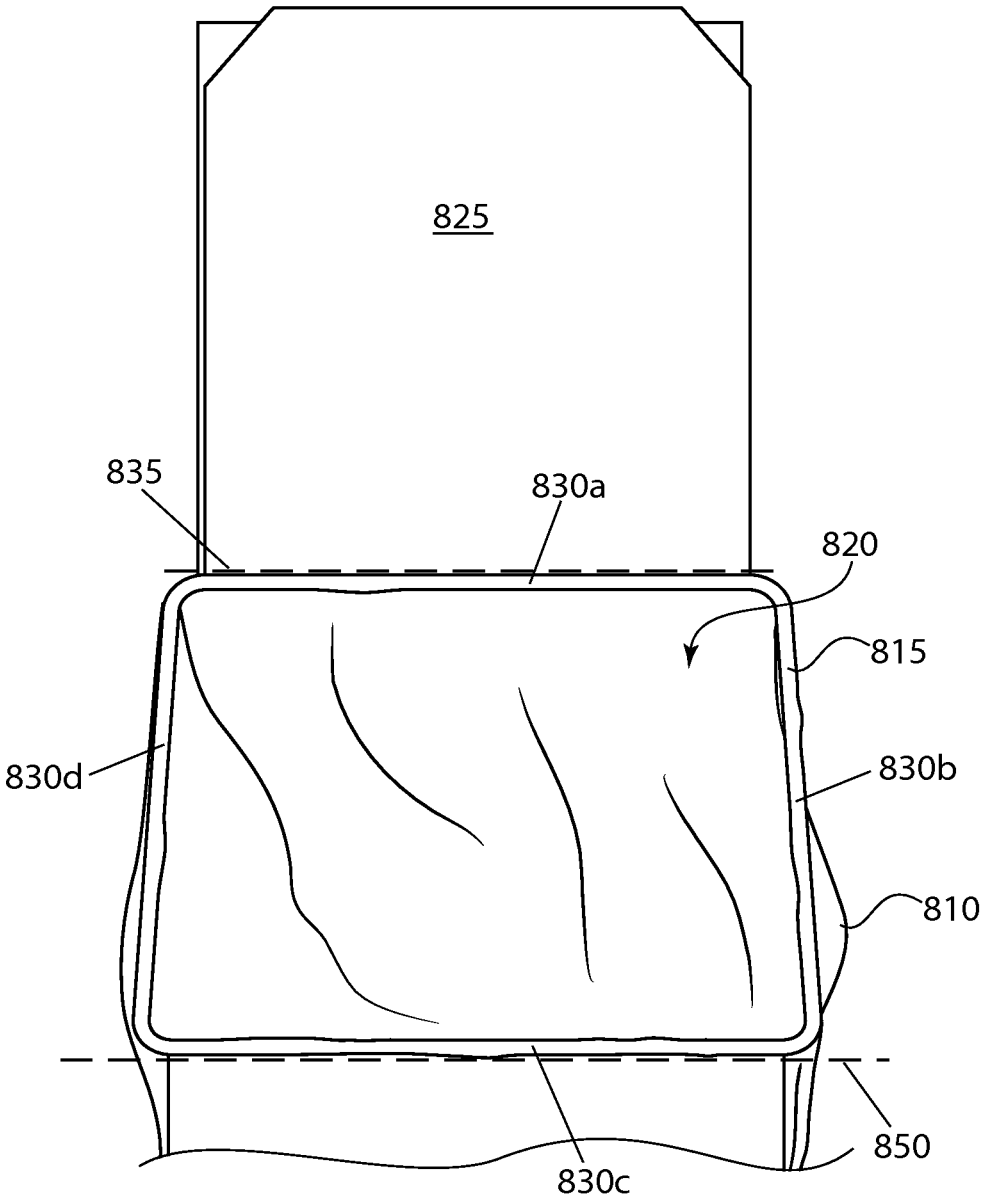
FIG. 8C is a perspective view of an example of a single-handed waste pick-up and storage device according to an embodiment of the present invention.

FIGS. 8A to 8F shows an example of a single-handed waste pick-up and storage device according to an embodiment of the present invention. FIG. 8A is a side view 800 of a single-handed device having a receptacle 805. FIG. 8B is another side view 860 of the single-handed device. FIG. 8C is a perspective view 865 of the single-handed device. The receptacle 805 is made of a combination of plastic, paper and/or metal. The receptacle 805 has a flexible plastic bag 810. The plastic bag is enclosed on one end and has an opening 820 on the opposite end. The plastic bag 810 has a frame 815 mounted around the opening 820. The frame 815 ensures the bag 810 maintains the opening 820. The frame 815 can be a wire frame. The frame can be any shape, including but not limited to a square, rectangular, and circular. In an embodiment, the frame can be attached to the outside surface of the bag. In an embodiment, the frame can be attached to the inside surface of the bag.

The frame 815 can be shaped to match a cover 825. For example, the cover 825 and frame 815 can be square, so that all four sides 830*a* to 830*d* are equal in length. Cover 825 can have chamfered edges. In an embodiment, cover 825 has scalloped, and/or rounded edges. The cover 825 is attached at one end of the frame 815 and bag 810. Cover 825 can rotate around an axis of rotation 835 to cover the opening 820. The cover 825 can be coupled to the frame 815 and/or bag 810 such that the cover slidably covers the opening 820. For example, the cover 825 can slide closed from one side of frame 815 to the opposite side of frame 815. The cover 825 can be coupled to the frame 815 and/or bag 810 such that the cover pivots around a corner point of frame 815 to cover the opening 820. The axis of rotation 835 is substantially parallel to side 830*a*. In an embodiment, cover 825 can swivel around an axis to close opening 820. Cover 825 is made of inflexible material, for example, cardboard or hard plastic. Cover 825 simultaneously acts as a cover for the frame 815 and bag 810 as well as a scoop to insert litter into the bag 810.

Figure 8D:
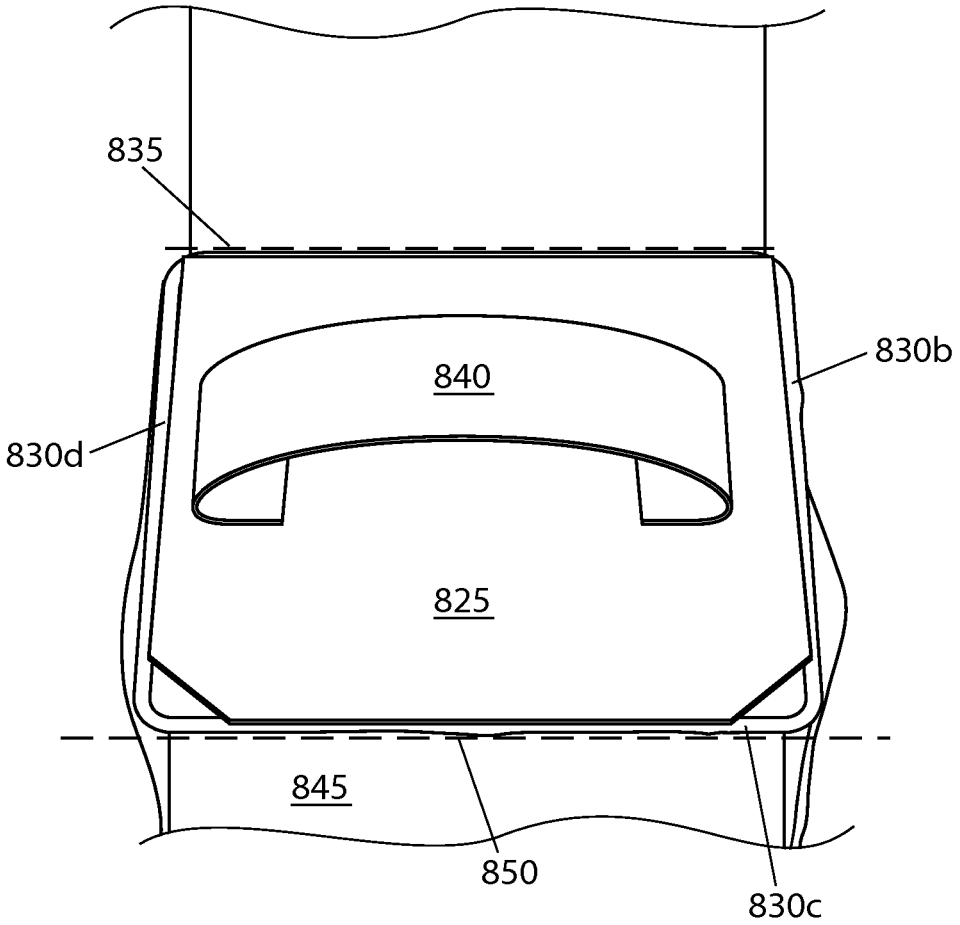
FIG. 8D is a top-down view of an example of a single-handed waste pick-up and storage device according to an embodiment of the present invention.

FIG. 8D shows a top-down view 870 showing the cover 825. Cover 825 can have a handle, or strap 840 attached at opposites ends of the cover and substantially parallel to sides 830*b* and 830*d*. The strap 840 can be made from any flexible material, for example, textiles, or paper. The strap 840 can be attached to cover 825 using adhesive or mechanical joining. The strap 840 can be enclosed on one end to form a protective shield or glove around the user's hand (not shown).

Figure 8E:
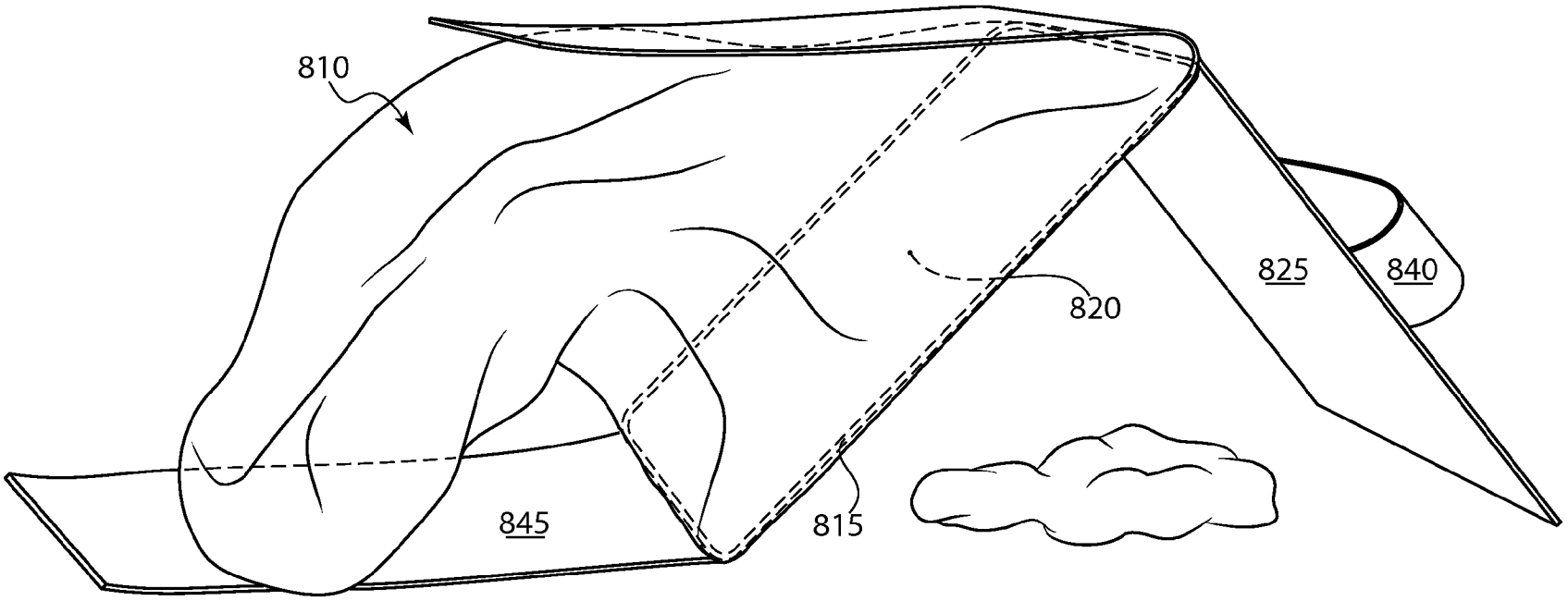
FIG. 8E is a side view of an example of a single-handed waste pick-up and storage device according to an embodiment of the present invention in waste pick-up mode.

FIG. 8E shows a side view 875 of the receptacle in pick-up mode. When the receptacle 805 is in pick-up mode, the user can invert the receptacle 805 with one hand. For example, the side 830*c* and the cover 825 can contact a surface where the litter or waste is located (e.g., ground and/or cement). As shown in FIG. 8E, the inverted frame 815 and cover 825 can surround the litter, and the user can sweep the waste into the bag 810 using cover 825. In an embodiment, sides 830*b* and/or 830*d* can have a mechanism to allow a user's thumb to ensure the frame 815 remains open when inverted (not shown). In an embodiment, sides 715*a* and/or 715*c* can have a mechanism to allow a user's thumb to ensure the box remains open when inverted (not shown). For example, a hook, loop, ledge, lip, and other known protrusions allow a user to maintain the opening when the receptacle is in waste pick-up mode. A hook, loop and/or other known protrusions can be a protrusion that encompasses a user's thumb to allow the user to manipulate the receptacle and counteract the force of gravity when the receptacle is inverted. Similarly, a ledge, lip, and other known protrusions can be a protrusion that has a surface upon which the user can apply a force to counteract the force of gravity.

Figure 8F:
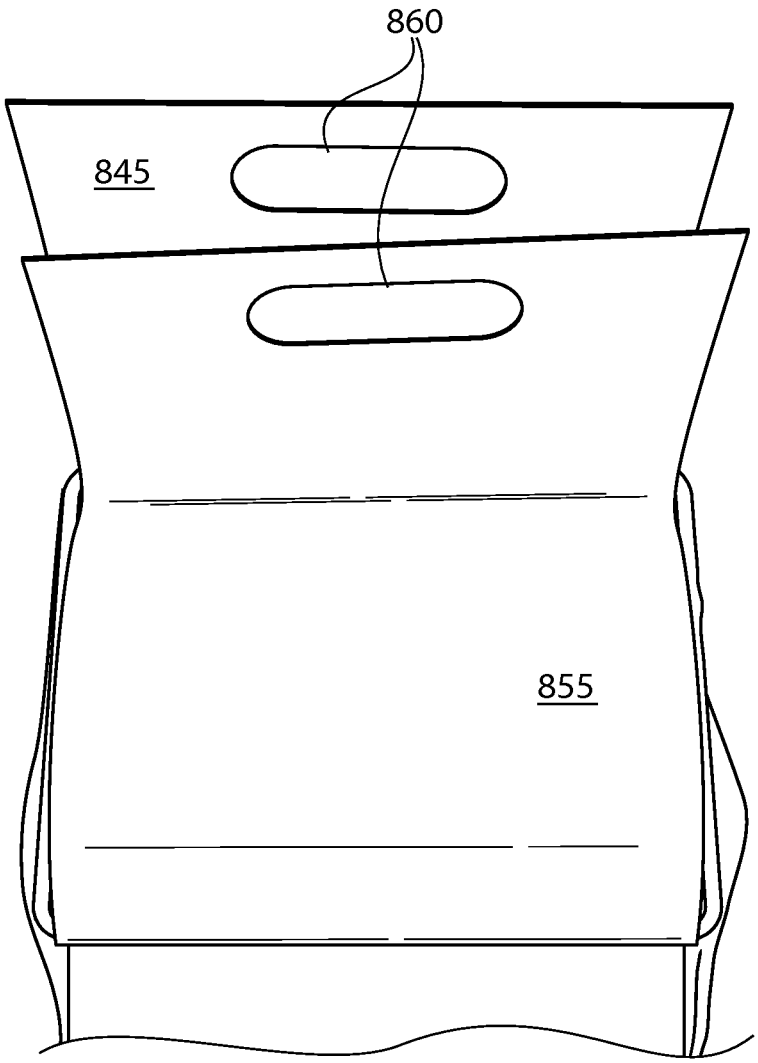
FIG. 8F is a top-down view of an example of a single-handed waste pick-up and storage device according to an embodiment of the present invention in waste storage mode.

Flap 845 is attached to side 830*c*. Flap 845 can be attached to frame 815 and/or bag 810 using adhesive or mechanical joining. Flap 845 can be flexible or inflexible. Flap 845 can rotate about an axis of rotation 850 that is substantially parallel to side 830*c*. Flap 845 is rotatable around axis 850 so that it does not interfere with the user when the receptacle 805 is in pick-up mode (as shown in FIG. 8E), but can be used when the receptacle 805 is in storage mode. Flap 855 is attached to side 830*a*. Flap 855 is attached to frame 815 and/or bag 810 and/or cover 825 using adhesive or mechanical joining. Flap 855 is rotatable around axis of rotation 835 so that it does not interfere with the user when the receptacle 805 is in pick-up mode, but can be used when the receptacle is in storage mode. When the receptacle 805 is in storage mode, the user can use the flaps 845 and 855 to move the receptacle for disposal. FIG. 8F shows a top-down view 880 of the receptacle 805 in storage mode. Flap 855 has a length L1 and flap 845 has a length L2. L1 is greater than L2 so flap 855 can cover the opening 820 and cover 825 and match the length of flap 845, L2, as also shown in FIGS. 8A and 8B. Flap 855 covers the opening 820 such that the cover 825 is angled substantially opposite to its opening to prevent waste and/or litter from falling out while in storage mode. Flaps 845 and 855 each have cutouts, or grips, 860, that are positioned to match each other.

Figure 10A:
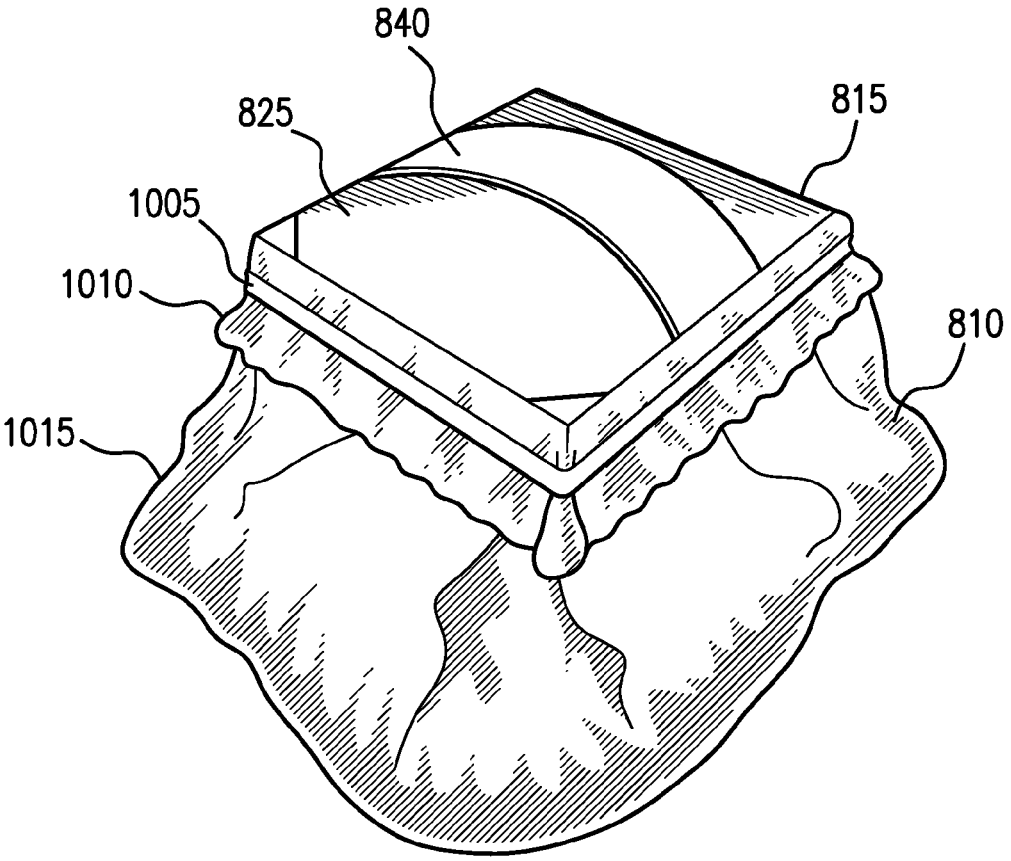
FIG. 10A is a perspective view of another example of a singled-handed waste pick-up and storage device according to an embodiment of the present invention of a frame positioned inside a bag.
Figure 10B:
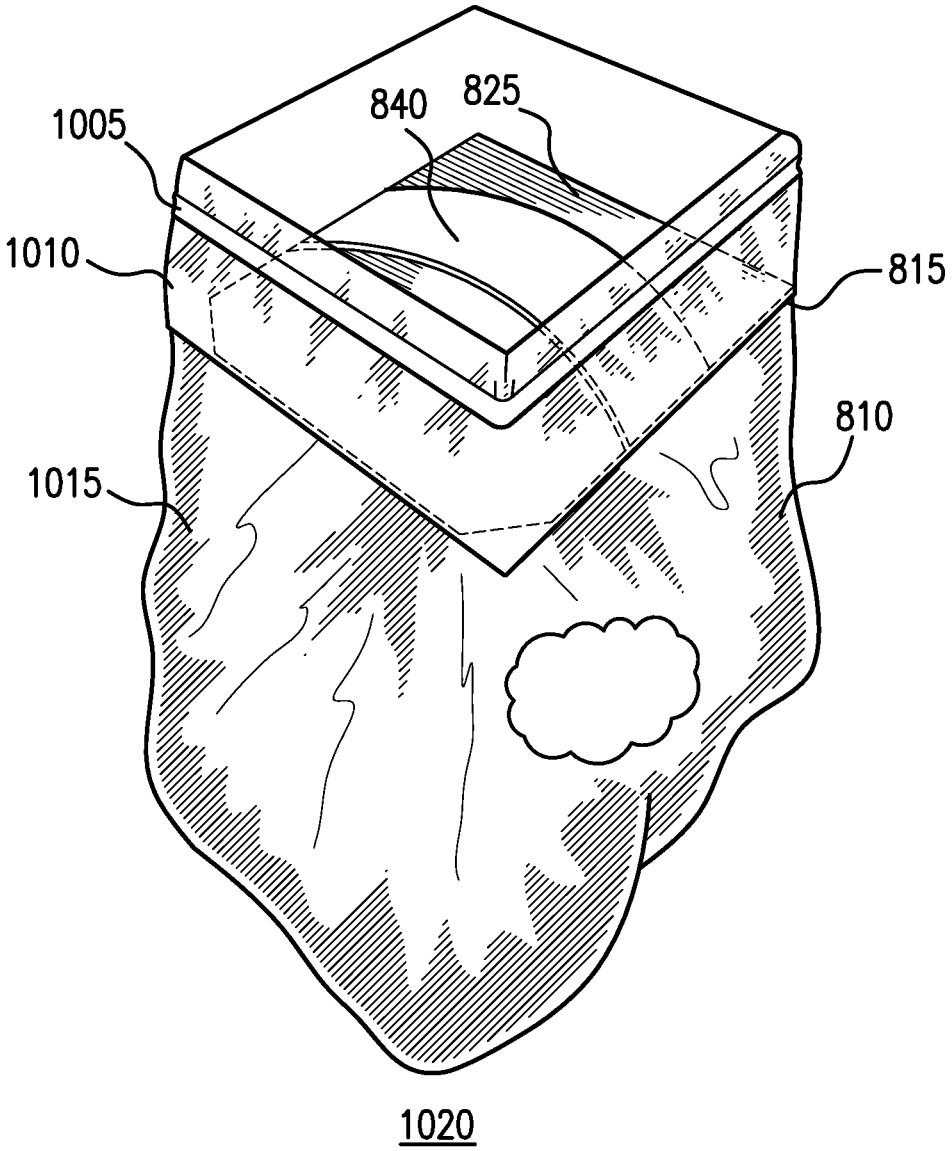
FIG. 10B is a perspective view of an example of a single-handed waste pick-up and storage device according to an embodiment of the present invention of a bag enclosing a cover.
Figure 10C:
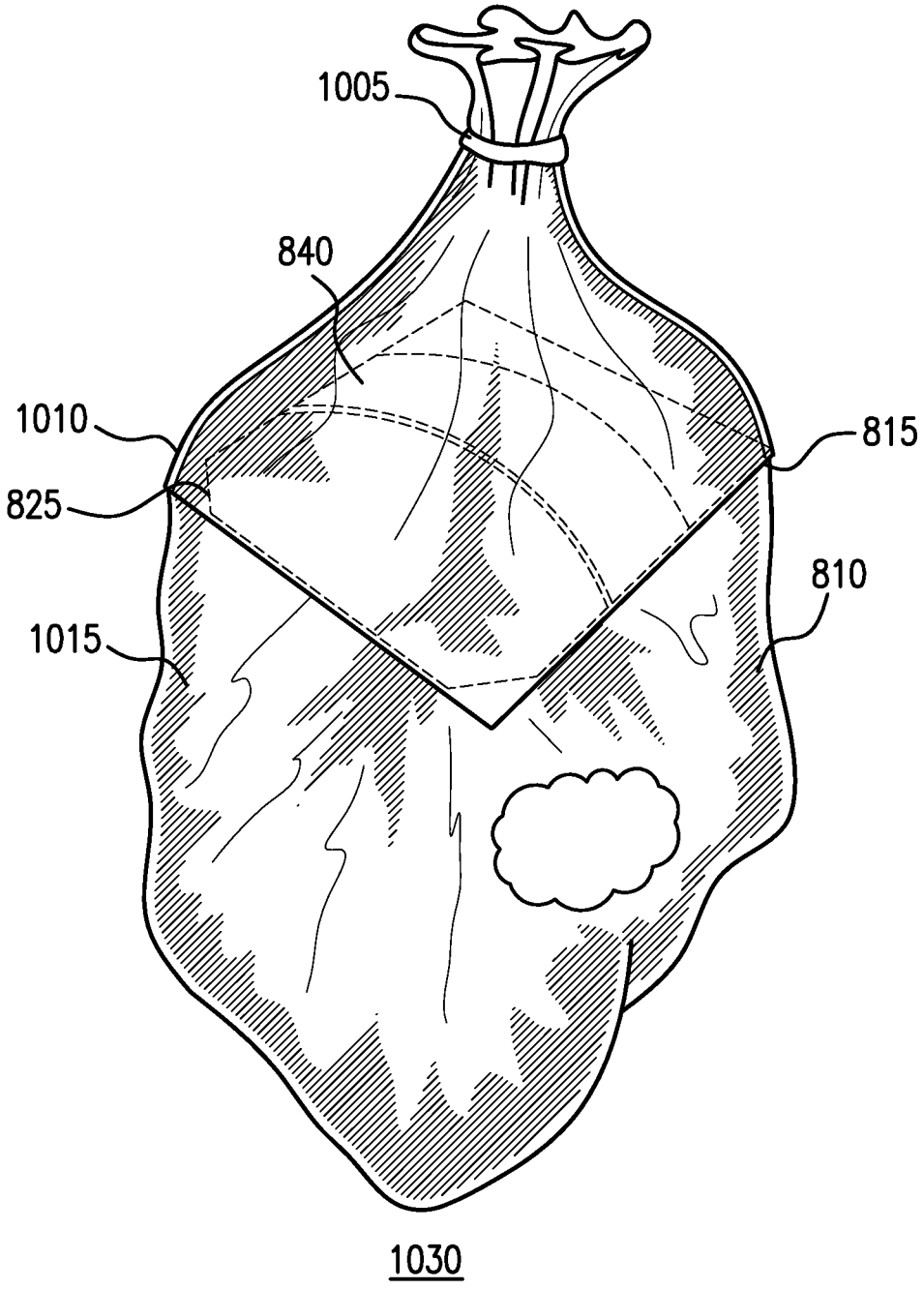
FIG. 10C is a perspective view of an example of a single-handed waste pick-up and storage device according to an embodiment of the present invention of a sealed bag enclosing a cover.

FIGS. 10A to 10C show an example of an embodiment of a single-handed waste pick-up and disposal device. An embodiment of a one-handed device includes the frame 815 attached to the bag 810 at a position below the opening, such that a portion of bag 1010 is above the frame 815 and a portion of the bag 1015 is below the frame 815. FIG. 10A shows an example of the portion of bag 1010 above the frame 815 can be folded over so as to not interfere with the user. The portion above the frame 1010 is enough to gather together above the cover 825 to seal the bag 810. The frame 815 maintains the opening 820. The waste is swept into the bag 810 by the cover 825, the portion of bag 810 above the frame can be drawn over the cover 825 to seal the bag for storage mode. FIG. 10B shows an example of the device after pick-up mode. The portion of the bag above the frame 1010 can be raised over the frame 815, cover 825 and opening 820 for sealing. FIG. 10C shows the drawstring 1005 closed, sealing the bag 810. The frame 810 and cover 825 are enclosed in the bag 810. The drawstring 1005 can be a continuous drawstring that the user can seal by pulling the drawstring 1005 to tie off. In an embodiment, the drawstring 1005 can have two ends that the user can tie together, sealing the bag by pulling each end in substantially opposite directions. In an embodiment, the drawstring 1005 can have a mechanical lockslide to seal the bag. The drawstring 1005 is movably attached to the bag 810. The drawstring 1005 can be attached to the bag by material to create a defined path for the drawstring to slide. In an embodiment, the drawstring 1005 can be attached to a bag as a conventional drawstring.

The bag can be sealed using adhesives and/or tying, and/or mechanical joining. In an embodiment, the receptacle can be sealed by adhesives or mechanical couplings. In an embodiment, an adhesive can be tape with a removable cover strip, VELCRO, or other conventional methods for sealing containers when desired. The receptacle 610 can be sealed by any adhesives, including but not limited to glue, epoxy, and tape. The receptacle can be sealed by a mechanical coupling. A mechanical coupling includes, but is not limited to, staples, clips, hooks, closures, and other known fasteners The bag 810 can have a drawstring to seal the contents. Drawstring 905, as shown in FIGS. 9A and 9B, can include two ends, where the ends are drawn substantially opposite of each other. The drawstring can be a continuous string, as shown in FIGS. 10A to 10C, that the user manually uses to seal the bag. The drawstring can also have a mechanical coupling, such as a lockslide (not shown) to maintain the closure.

In an embodiment, a second plastic bag can be attached to the outside of the cover 825 to enclose the opening 825, bag 810, and cover 825 when the receptacle is in storage mode. The second bag can be sealed in the manner as described above.

The an embodiment described herein can be made of materials including but not limited to paper, plastic, and/or metal. For example, receptacles can be made from a flexible plastic bag, and/or a flexible paper bag. The panels and covers can be made from inflexible material, such as plastic, metal, and/or cardboard. In an embodiment, the paper is uncoated. In an embodiment, the paper can be coated. For example, the paper can have a wax coating, coatings to increase durability, and/or coatings to waterproof the paper. The coatings can have anti-bacterial, anti-odor, and/or disinfectant for the user's benefit. The coating can be a non-stick coating, to prevent residue from remaining on the device. The coating can include baking soda as a deodorant.

The use of the words "object", "litter", and "waste" are all examples of any object to be picked up and disposed of by picking it up and isolating it in a receptacle prior to disposal. The use of "sweep", "push", "scooped", and "inserting" are examples of isolating an object into a receptacle. The flaps and/or covers of the embodiment can be manipulated by the user to isolate the object for disposal. The use of "crease", "fold", "perforation", "cut marks", and "line" are used to describe a material having one or more predefined markings to affect the structure of the material. The use of "detachable" and "removable" are used to describe certain features that can be separated from another feature. The use of "coupled" and "joined" are used to describe that features are connected to one another.

The descriptions and illustrations of the embodiment above should be read as example of a and not limiting. For example, the device can be used for any variety of waste, or any object that can need to be sequestered, such as food. Modifications, variations, and improvements are possible in light of the teachings above and the claims below, and are intended to be within the spirit and scope of the invention.

Although the present invention has been described with reference to particular examples and embodiments, it is understood that the present invention is not limited to those examples and embodiments. The present invention includes variations from the specific examples and embodiments described herein. Except to the extent necessary or inherent in the processes themselves, no particular order to steps or stages of methods or processes described in this disclosure, including the figures is implied. In many cases, the order of process steps may be varied without changing the purpose, effect or import of the methods described.

What is claimed is:

1. A waste pick-up and storage device comprising:
- a receptacle, the receptacle having a base and four sides, wherein a first and second side are opposite from each other, and a third side is opposite from a fourth side; and
- a cover rotatably attached to the receptacle;
- wherein the cover has a handle attached to a surface opposite the base of the receptacle;
- wherein the first and second sides are a first height, the third side is a second height, and the fourth side is a third height; and
- wherein the second height is larger than the first height, and the third height is larger than the first height and the second height.

2. The waste pick-up and storage device of claim 1, wherein the cover is rotatable around an axis substantially parallel to the third side and substantially perpendicular to the first and second sides.

3. The waste pick-up and storage device of claim 1, wherein the third and fourth sides have cutouts.

4. The waste pick-up and storage device of claim 1, wherein the handle is enclosed on one end.

5. The waste pick-up and storage device of claim 1, wherein the handle is a strap.

6. The waste pick-up and storage device of claim 1, wherein the first and second sides each have a reinforcement strip positioned substantially parallel to the first and second sides and substantially perpendicular to the third and fourth sides and attached at the first height.

7. The waste pick-up and storage device of claim 1, wherein a panel is attached to at least a portion of the third side.

8. The waste pick-up and storage device of claim 1, wherein a portion of the fourth side encloses the cover.

9. A waste pick-up and storage device comprising:
- a receptacle having an opening;
- a frame, wherein the frame is attached to the opening of the receptacle; and
- a cover rotatably attached to the frame and/or receptacle;
- wherein the cover has a handle attached to a surface opposite a base of the receptacle;
- wherein a first flap is attached to a first side of the frame and/or receptacle and positioned opposite from a second flap attached to a second side of the frame and/or receptacle; and
- wherein the first and second flaps have cutouts.

10. The waste pick-up and storage device of claim 9, wherein the first flap has a first height and the second flap has a second height, and the first height is larger than the second height.

11. The waste pick-up and storage device of claim 9, wherein the handle is enclosed on one end.

12. The waste pick-up and storage device of claim 11, wherein the handle is a strap.

13. The waste pick-up and storage device according to claim 9, wherein the receptacle further includes a drawstring, such that the drawstring seals the opening of the receptacle.

14. A waste pick-up and storage device comprising:
- a receptacle having an opening;
- a frame, wherein the frame is attached to the opening of the receptacle; and
- a cover rotatably attached to the frame and/or receptacle;
- wherein the cover has a handle attached to a surface opposite a base of the receptacle;
- wherein a first flap is attached to a first side of the frame and/or receptacle and positioned opposite from a second flap attached to a second side of the frame and/or receptacle; and
- wherein a portion of the first flap encloses the cover.

15. A waste pick-up and storage device comprising:
- a receptacle, comprising:
  - a bag having an opening; and
  - a frame, wherein the frame is attached to the inside surface of the bag; and
- a cover rotatably attached to the frame and/or bag;
- wherein the cover has a handle attached to a surface opposite a base of the bag; and
- wherein the frame is positioned in the receptacle such that the bag has a first portion above the frame.

16. The waste pick-up and storage device of claim 15, wherein the first portion encloses the cover.

17. The waste pick-up and storage device of claim 15, wherein the first portion includes a drawstring.

18. A method for picking up and storing an object using a single-handed device, the method comprising:
- rotating a cover attached to a receptacle to open the receptacle, and a frame attached to an opening of the receptacle;
- a user inverting the receptacle such that the opening is facing towards an object, wherein the user manipulates the device by a handle attached to the cover;
- using the cover to move the object into the receptacle, the cover including a handle attached to a surface opposite a base of the receptacle; and
- inverting the receptacle with the cover enclosing the opening for storage;

wherein a first flap is attached to a first side of the frame and/or receptacle and positioned opposite from a second flap attached to a second side of the frame and/or receptacle; and wherein the first and second flaps have cutouts.

19. The method of claim 18, further comprising closing and/or sealing the receptacle for storage.

* * * * *